US008045907B2

(12) United States Patent
Iwai

(10) Patent No.: US 8,045,907 B2
(45) Date of Patent: Oct. 25, 2011

(54) FIXING DEVICE AND IMAGE FORMING APPARATUS

(75) Inventor: Kiyoshi Iwai, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 42 days.

(21) Appl. No.: 12/559,807

(22) Filed: Sep. 15, 2009

(65) Prior Publication Data

US 2010/0247184 A1 Sep. 30, 2010

(30) Foreign Application Priority Data

Mar. 24, 2009 (JP) ..... 2009-071545

(51) Int. Cl.
*G03G 15/20* (2006.01)

(52) U.S. Cl. ..... 399/329; 399/333

(58) Field of Classification Search ..... 399/69, 399/328, 329, 333, 156, 330
See application file for complete search history.

(56) References Cited

U.S. PATENT DOCUMENTS

| | | | | |
|---|---|---|---|---|
| 6,978,110 | B2 | 12/2005 | Nakayama | |
| 7,079,801 | B2 | 7/2006 | Nakayama | |
| 7,664,451 | B2 | 2/2010 | Baba et al. | |
| 2008/0063445 | A1 * | 3/2008 | Imai et al. | 399/333 |
| 2008/0124111 | A1 | 5/2008 | Baba et al. | |
| 2008/0124147 | A1 * | 5/2008 | Uehara et al. | 399/329 |
| 2009/0028617 | A1 * | 1/2009 | Katakabe et al. | 399/333 |

FOREIGN PATENT DOCUMENTS

| | | |
|---|---|---|
| JP | 10-171279 | 6/1998 |
| JP | 2003-186322 | 7/2003 |
| JP | 2005-316120 | 11/2005 |
| JP | 2007-057689 | 3/2007 |
| JP | 2008-003473 | 1/2008 |
| JP | 2008-015398 | 1/2008 |
| JP | 2008-152247 | 7/2008 |
| JP | 2008-249850 | 10/2008 |

* cited by examiner

*Primary Examiner* — David Porta
*Assistant Examiner* — Marcus Taningco
(74) *Attorney, Agent, or Firm* — Morgan, Lewis & Bockius LLP

(57) ABSTRACT

The fixing device includes: a fixing member including a conductive layer and fixing toner on a recording medium by electromagnetic induction; a magnetic-field generating member generating an alternate-current magnetic field intersecting with the conductive layer; a magnetic-path forming member that includes a circular arc facing the magnetic-field generating member, that forms a magnetic path of the alternate-current magnetic field, within a range up to a permeability change start temperature, and that allows the alternate-current magnetic field to go through the magnetic-path forming member within a range exceeding the permeability change start temperature; and a support member supporting the magnetic-path forming member. The circular arc shaped portion has an upstream edge in a moving direction of the fixing member and a position of the upstream edge is concaved toward a center of the magnetic path forming member from each of ends of the magnetic path forming member in a longitudinal direction.

8 Claims, 16 Drawing Sheets

FIXING DEVICE AND IMAGE FORMING APPARATUS

CROSS REFERENCE TO RELATED APPLICATIONS

This application is based on and claims priority under 35 USC §119 from Japanese Patent Application No. 2009-071545 filed Mar. 24, 2009.

BACKGROUND

1. Technical Field

The present invention relates to a fixing device and an image forming apparatus.

2. Related Art

Fixing devices using an electromagnetic induction heating method are known as the fixing devices each to be installed in an image forming apparatus such as a copy machine and a printer using an electrophotographic method.

SUMMARY

According to an aspect of the present invention, there is provided a fixing device including: a fixing member that includes a conductive layer and that fixes toner on a recording medium by self-heating the conductive layer by electromagnetic induction; a magnetic field generating member that generates an alternate-current magnetic field intersecting with the conductive layer of the fixing member; a magnetic path forming member that includes a circular arc shaped portion arranged so as to face the magnetic field generating member with the fixing member interposed between the circular arc shaped portion and the magnetic field generating member, that forms a magnetic path of the alternate-current magnetic field generated by the magnetic field generating member, within a temperature range up to a permeability change start temperature at which a permeability starts to decrease in the circular arc shaped portion, and that allows the alternate-current magnetic field generated by the magnetic field generating member to go through the magnetic path forming member within a temperature range exceeding the permeability change start temperature; and a support member that supports the magnetic path forming member. The circular arc shaped portion of the magnetic path forming member having an upstream edge in a moving direction of the fixing member and a position of the upstream edge is concaved toward a center of the magnetic path forming member from each of ends of the magnetic path forming member in a longitudinal direction.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described below in detail with reference to the accompanying drawings.

<Description of Image Forming Apparatus>

Figure 1:
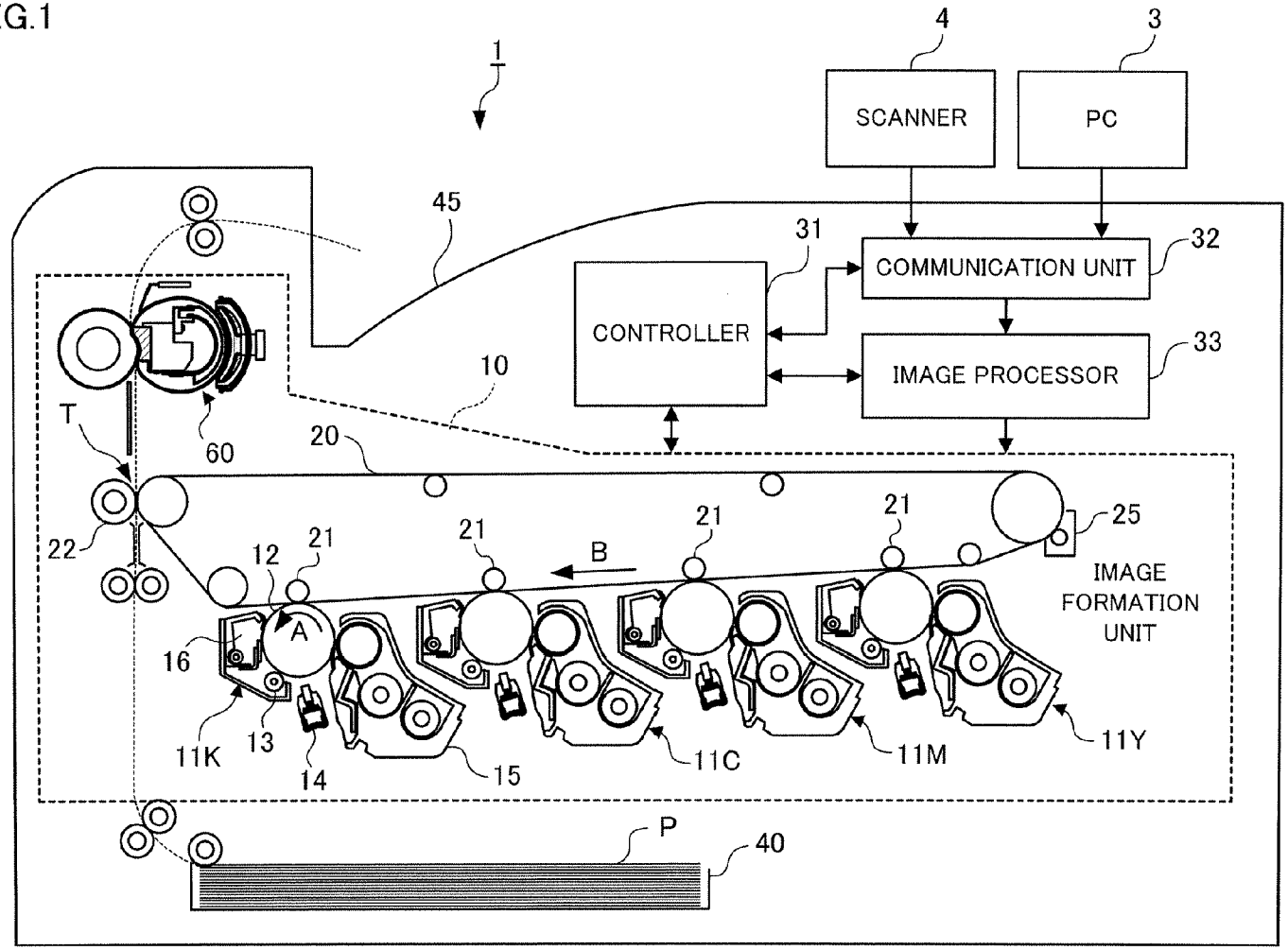
FIG. 1 is a diagram showing a configuration example of an image forming apparatus to which a fixing device of the exemplary embodiment is applied.

FIG. 1 is a diagram showing a configuration example of an image forming apparatus to which a fixing device of the exemplary embodiment is applied. An image forming apparatus 1 shown in FIG. 1 is a so-called tandem-type color printer, and includes: an image formation unit 10 that performs image formation on the basis of image data; and a controller 31 that controls operations of the entire image forming apparatus 1. The image forming apparatus 1 further includes: a communication unit 32 that communicates with, for example, a personal computer (PC) 3, an image reading apparatus (scanner) 4 or the like to receive image data; and an image processor 33 that performs image processing set in advance on image data received by the communication unit 32.

The image formation unit 10 includes four image forming units 11Y, 11M, 11C and 11K (also collectively referred to as an "image forming unit 11") as examples of a toner image forming unit, which are arranged side by side at certain intervals. Each of the image forming units 11 includes: a photoconductive drum 12 as an example of an image carrier that forms an electrostatic latent image and holds a toner image; a charging device 13 that uniformly charges the surface of the photoconductive drum 12 at a predetermined potential; a light emitting diode (LED) print head 14 that exposes, on the basis of color image data, the photoconductive drum 12 charged by the charging device 13; a developing device 15 that develops the electrostatic latent image formed on the photoconductive drum 12; and a cleaner 16 that cleans the surface of the photoconductive drum 12 after transfer.

The image forming units 11 have almost the same configuration except toner contained in the developing device 15, and form yellow (Y), magenta (M), cyan (C) and black (K) color toner images, respectively.

Further, the image formation unit 10 includes: an intermediate transfer belt 20 onto which multiple layers of color toner images formed on the photoconductive drums 12 of the image forming units 11 are transferred; and primary transfer rolls 21 that sequentially transfer (primarily transfer) color toner images formed in respective image forming units 11 onto the intermediate transfer belt 20. Furthermore, the image formation unit 10 includes: a secondary transfer roll 22 that collectively transfers (secondarily transfers) the color toner images superimposingly transferred onto the intermediate transfer belt 20 onto a sheet P which is a recording medium (recording sheet); and a fixing unit 60 as an example of a fixing unit (a fixing device) that fixes the color toner images having been secondarily transferred, onto the sheet P. Note that, in the image forming apparatus 1 according to the present exemplary embodiment, the intermediate transfer belt 20, the primary transfer rolls 21 and the secondary transfer roll 22 configure a transfer unit.

In the image forming apparatus 1 of the present exemplary embodiment, image formation processing using the following processes is performed under operations controlled by the controller 31. Specifically, image data from the PC 3 or the scanner 4 is received by the communication unit 32, and after the image data is subjected to certain image processing performed by the image processor 33, the image data of each color is generated and sent to a corresponding one of the image forming units 11. Then, in the image forming unit 11K that forms a black-color (K) toner image, for example, the photoconductive drum 12 is uniformly charged by the charging device 13 at the potential set in advance while rotating in a direction of an arrow A, and then is exposed by the LED print head 14 on the basis of the black color image data transmitted from the image processor 33. Thereby, an electrostatic latent image for the black-color image is formed on the photoconductive drum 12. The black-color electrostatic latent image formed on the photoconductive drum 12 is then developed by the developing device 15. Then, the black-color toner image is formed on the photoconductive drum 12. In the same manner, yellow (Y), magenta (M) and cyan (C) color toner images are formed in the image forming units 11Y, 11M and 11C, respectively.

The color toner images formed on the respective photoconductive drums 12 in the image forming units 11 are electrostatically transferred (primarily transferred), in sequence, onto the intermediate transfer belt 20 that moves in a direction of an arrow B, by the primary transfer rolls 21. Then, superimposed toner images on which the color toner images are superimposed on one another are formed. Then, the superimposed toner images on the intermediate transfer belt 20 are transported to a region (secondary transfer portion T) at which the secondary transfer roll 22 is arranged, along with the movement of the intermediate transfer belt 20. The sheet P is supplied from a sheet holding unit 40 to the secondary transfer portion T at a timing when the superimposed toner images being transported arrive at the secondary transfer portion T. Then, the superimposed toner images are collectively and electrostatically transferred (secondarily transferred) onto the transported sheet P by action of a transfer electric field formed at the secondary transfer portion T by the secondary transfer roll 22.

Thereafter, the sheet P onto which the superimposed toner images are electrostatically transferred is transported toward the fixing unit 60. The toner images on the sheet P transported to the fixing unit 60 are heated and pressurized by the fixing unit 60 and thereby are fixed onto the sheet P. Then, the sheet P including the fixed images formed thereon is transported to a sheet output unit 45 provided at an output portion of the image forming apparatus 1.

Meanwhile, the toner (primary-transfer residual toner) attached to the photoconductive drums 12 after the primary transfer and the toner (secondary-transfer residual toner) attached to the intermediate transfer belt 20 after the secondary transfer are removed by the cleaners 16 and a belt cleaner 25, respectively.

In this way, the image formation processing in the image forming apparatus 1 is repeatedly performed for a designated number of print sheets.

<Description of Configuration of Fixing Unit>

Next, a description will be given of the fixing unit 60 in the present exemplary embodiment.

Figure 2:
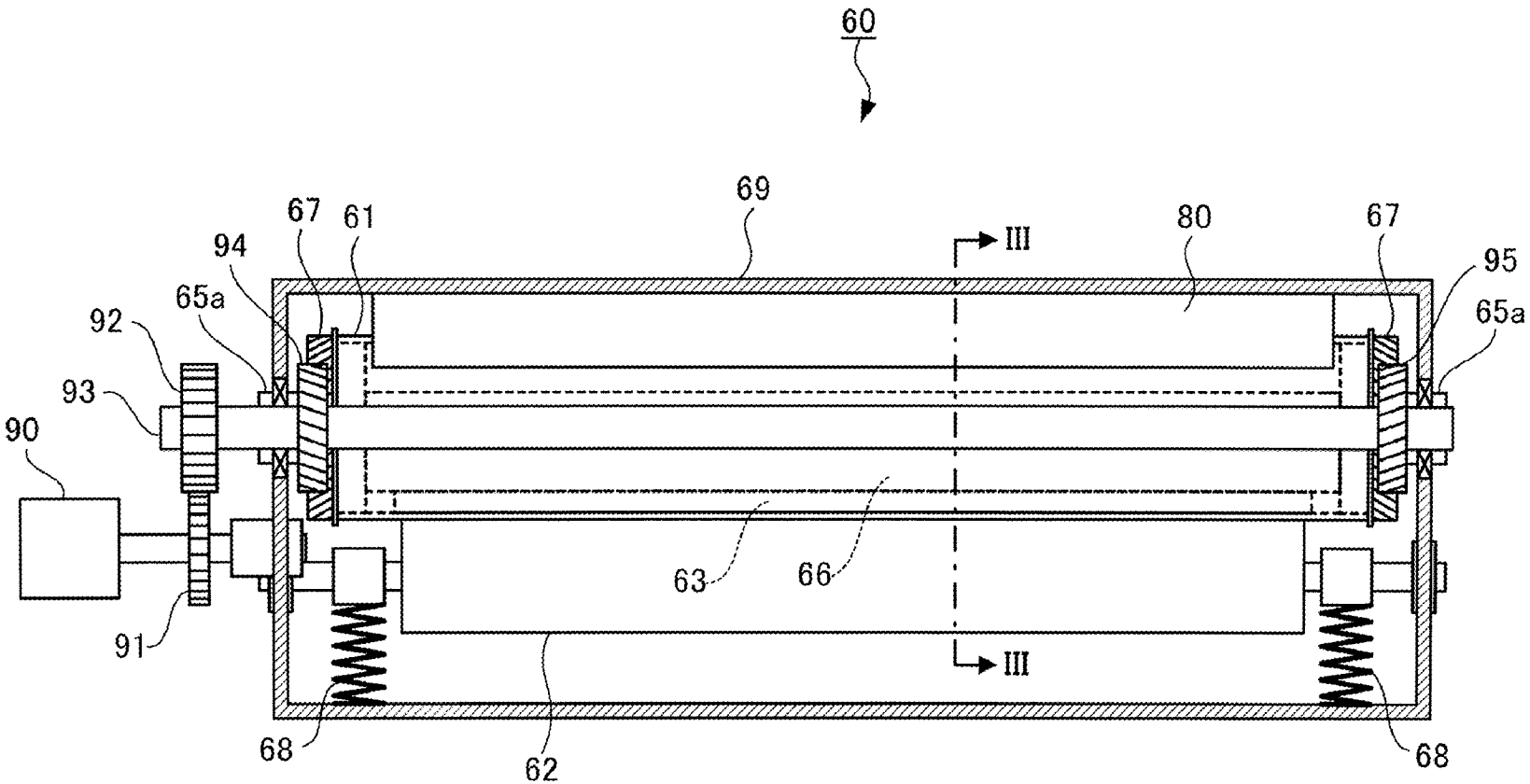
FIG. 2 is a front view of the fixing unit of the exemplary embodiment.
Figure 3:
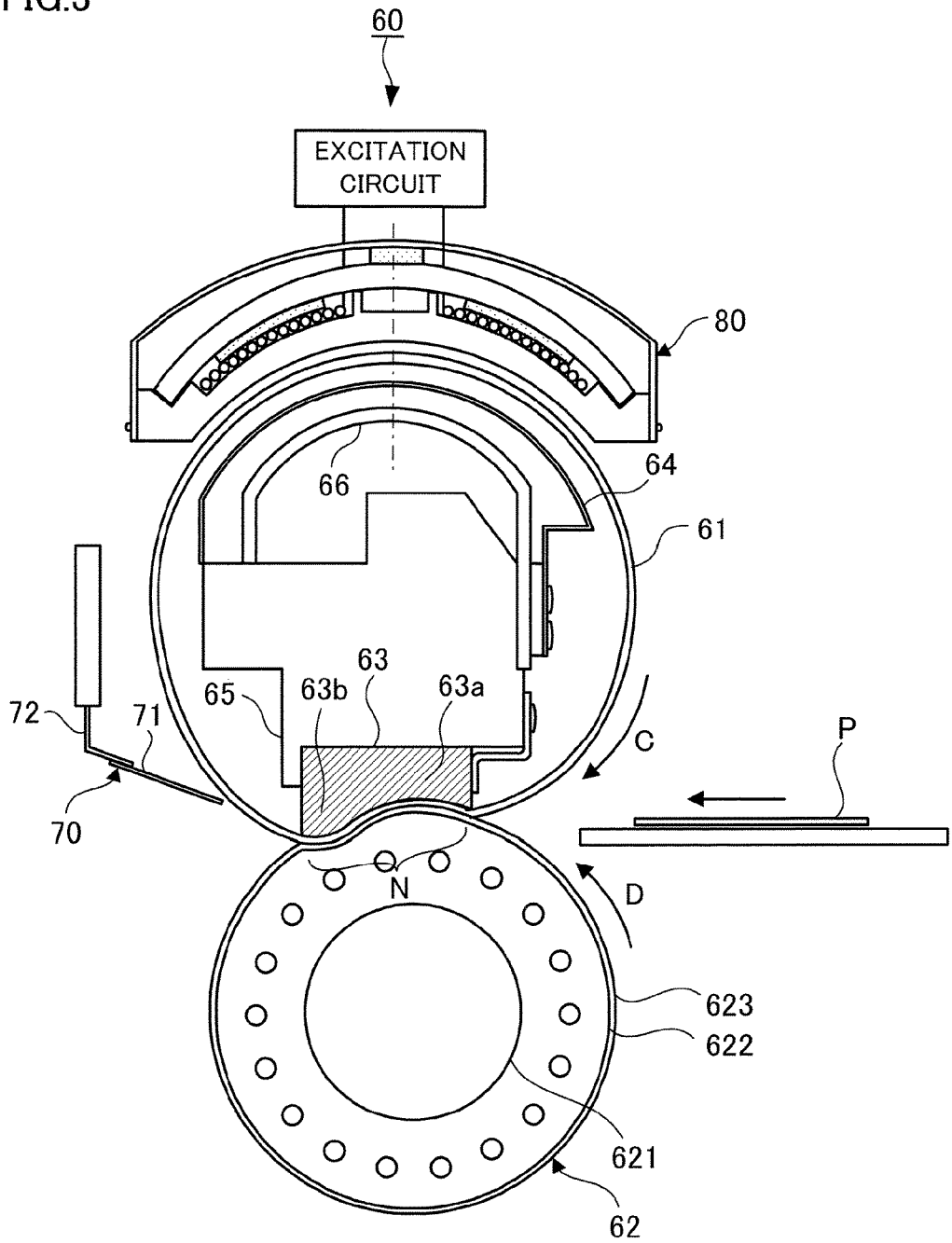
FIG. 3 is a cross sectional view of the fixing unit, taken along the line III-III in FIG. 2.

FIGS. 2 and 3 are diagrams showing a configuration of the fixing unit 60 of the exemplary embodiment. FIG. 2 is a front view of the fixing unit 60, and FIG. 3 is a cross sectional view of the fixing unit 60, taken along the line III-III in FIG. 2.

Firstly, as shown in FIG. 3, which is a cross sectional view, the fixing unit 60 includes: an induction heating (1H) heater 80 as an example of a magnetic field generating member that generates an AC (alternate-current) magnetic field; a fixing belt 61 as an example of a fixing member that is subjected to electromagnetic induction heating by the IH heater 80, and thereby fixes a toner image; a pressure roll 62 that is arranged in a manner to face the fixing belt 61; and a pressing pad 63 that is pressed by the pressure roll 62 with the fixing belt 61 therebetween.

The fixing unit 60 further includes: a holder 65 as an example of a support member that supports a constituent member such as the pressing pad 63; a temperature-sensitive magnetic member 64 that forms a magnetic path by inducing the AC magnetic field generated at the IH heater 80; an induction member 66 that induces magnetic field lines passing through the temperature-sensitive magnetic member 64; and a peeling assisting member 70 that assists peeling of the sheet P from the fixing belt 61.

<Description of Fixing Belt>

Figure 4:
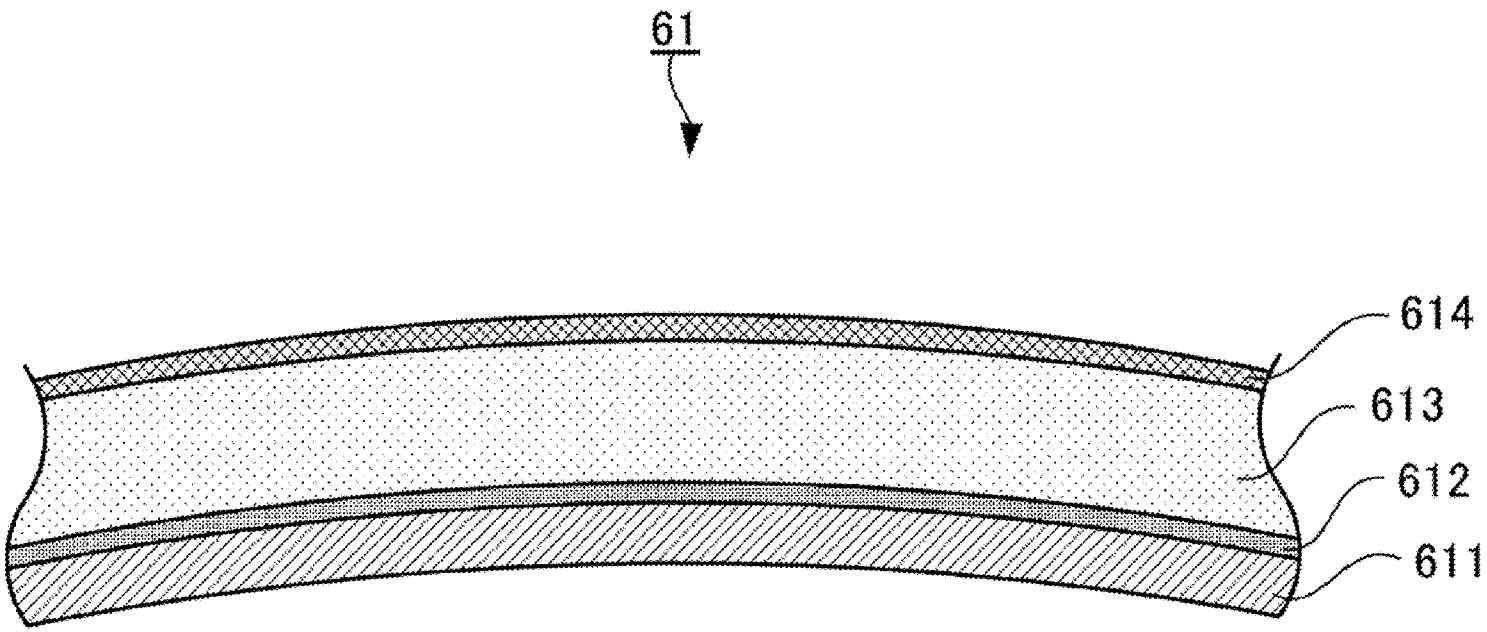
FIG. 4 is a configuration diagram showing cross sectional layers of the fixing belt.

The fixing belt 61 is formed of an endless belt member originally formed into a cylindrical shape, and is formed with a diameter of 30 mm and a width-direction length of 370 mm in the original shape (cylindrical shape), for example. In addition, as shown in FIG. 4 (a configuration diagram showing cross sectional layers of the fixing belt 61), the fixing belt 61 is a belt member having a multi-layer structure including: a base layer 611; a conductive heat-generating layer 612 that is coated on the base layer 611; an elastic layer 613 that improves fixing properties of a toner image; and a surface release layer 614 that is applied as the uppermost layer.

The base layer 611 is formed of a heat-resistant sheet-like member that supports the conductive heat-generating layer 612, which is a thin layer, and that gives a mechanical strength to the entire fixing belt 61. Moreover, the base layer 611 is formed of a specified material with a specified thickness. The base layer material has properties (relative permeability, specific resistance) that allow a magnetic field to pass therethrough so that the AC magnetic field generated at the IH heater 80 may act on the temperature-sensitive magnetic member 64. Meanwhile, the base layer 611 itself is formed so as not to generate heat by action of the magnetic field or not to easily generate heat.

Specifically, for example, a non-magnetic metal such as a non-magnetic stainless steel having a thickness of 30 to 200 μm (preferably, 50 to 150 μm), or a resin material or the like having a thickness of 60 to 200 μm is used as the base layer 611.

The conductive heat-generating layer 612 is an example of a conductive layer and is an electromagnetic induction heat-generating layer that is self-heated by electromagnetic induction of the AC magnetic field generated at the IH heater 80. Specifically, the conductive heat-generating layer 612 is a layer that generates an eddy current when the AC magnetic field from the IH heater 80 passes therethrough in the thickness direction.

Normally, an inexpensively manufacturable general-purpose power supply is used as the power supply for an excitation circuit that supplies an AC current to the IH heater 80 (also refer to later described FIG. 6). For this reason, in general, a frequency of the AC magnetic field generated by the IH heater 80 ranges from 20 kHz to 100 kHz by use of the general-purpose power supply. Accordingly, the conductive heat-generating layer 612 is formed to allow the AC magnetic field having a frequency of 20 kHz to 100 kHz to enter and to pass therethrough.

A region of the conductive heat-generating layer 612, where the AC magnetic field is allowed to enter is defined as a "skin depth δ" representing a region where the AC magnetic field attenuates to 1/e. The skin depth δ is calculated by use of the following formula (1), where f is a frequency of the AC magnetic field (20 kHz, for example), p is a specific resistance value (Ω·m), and $\mu_r$ is a relative permeability.

Accordingly, in order to allow the AC magnetic field having a frequency of 20 kHz to 100 kHz to enter and then to pass through the conductive heat-generating layer 612, the thickness of the conductive heat-generating layer 612 is formed to be smaller than the skin depth δ of the conductive heat-generating layer 612, which is defined by the formula (I). In addition, as the material that forms the conductive heat-generating layer 612, a metal such as Au, Ag, Al, Cu, Zn, Sn, Pb, Bi, Be or Sb, or a metal alloy including at least one of these elements is used, for example.

$$\delta = 503\sqrt{\frac{\rho}{f \cdot \mu_r}} \quad (1)$$

Specifically, as the conductive heat-generating layer 612, a non-magnetic metal (having a relative permeability substantially equal to 1) including Cu or the like, having a thickness of 2 to 20 μm and a specific resistance value not greater than $2.7\times10^{-8}$ Ω·m is used, for example.

In addition, in view of shortening the period of time required for self-heating the fixing belt 61 to reach a fixation setting temperature (hereinafter, referred to as a "warm-up time") as well, the conductive heat-generating layer 612 may be formed of a thin layer.

Next, the elastic layer 613 is formed of a heat-resistant elastic material such as a silicone rubber. The toner image to be held on the sheet P, which is to become the fixation target, is formed of a multi-layer of color toner as powder. For this reason, in order to uniformly supply heat to the entire toner image at a nip portion N, the surface of the fixing belt 61 may particularly be deformed so as to correspond with unevenness of the toner image on the sheet P. In this respect, a silicone rubber having a thickness of 100 to 600 μm and a hardness of 10° to 30° (JIS-A), for example, may be used for the elastic layer 613.

The surface release layer 614 directly contacts with an unfixed toner image held on the sheet P. Accordingly, a material with a high releasing property is used. For example, a PFA (a copolymer of tetrafluoroethylene and perfluoroalkylvinylether) layer, a PTFE (polytetrafluoroethylene) layer or a silicone copolymer layer or a composite layer formed of these layers is used. As to the thickness of the surface release layer 614, if the thickness is too small, no sufficient wear resistance is obtained, hence, reducing the life of the fixing belt 61. On the other hand, if the thickness is too large, the heat capacity of the fixing belt 61 becomes so large that the warm-up time becomes longer. In this respect, the thickness of the surface release layer 614 may be particularly 1 to 50 μm in consideration of the balance between the wear resistance and heat capacity.

<Description of Pressing Pad>

The pressing pad 63, which is an example of a pressing member, is formed of an elastic material such as a silicone rubber or fluorine rubber, and is supported by the holder 65 at a position facing the pressure roll 62. Then, the pressing pad 63 is arranged in a state of being pressed by the pressure roll 62 with the fixing belt 61 therebetween, and forms the nip portion N with the pressure roll 62.

In addition, the pressing pad 63 has different nip pressures set for a pre-nip region 63*a* on the sheet entering side of the nip portion N (upstream side in the transport direction of the sheet P) and a peeling nip region 63*b* on the sheet exit side of the nip portion N (downstream side in the transport direction of the sheet P), respectively. Specifically, a surface of the pre-nip region 63*a* at the pressure roll 62 side is formed into a circular arc shape approximately corresponding with the outer circumferential surface of the pressure roll 62, and the nip portion N, which is uniform and wide, is formed. Moreover, a surface of the peeling nip region 63*b* at the pressure roll 62 side is formed into a shape so as to be locally pressed with a larger nip pressure from the surface of the pressure roll 62 in order that a curvature radius of the fixing belt 61 passing through the nip portion N of the peeling nip region 63*b* may be small. Thereby, a curl (down curl) in a direction in which the sheet P is separated from the surface of the fixing belt 61 is formed on the sheet P passing through the peeling nip region 63*b*, thereby promoting the peeling of the sheet P from the surface of the fixing belt 61.

Note that, in the present exemplary embodiment, the peeling assisting member 70 is arranged at the downstream side of the nip portion N as an assistance unit for the peeling of the sheet P by the pressing pad 63. In the peeling assisting member 70, a peeling baffle 71 is supported by a holder 72 in a state of being positioned to be close to the fixing belt 61 in a direction opposite to the rotational moving direction of the fixing belt 61 (so-called counter direction). Then, the peeling baffle 71 supports the curl portion formed on the sheet P at the exit of the pressing pad 63, thereby preventing the sheet P from moving toward the fixing belt 61.

<Description of Temperature-sensitive Magnetic Member>

Next, the temperature-sensitive magnetic member 64 is formed into a circular arc shape (circular arc shaped portion) corresponding with an inner circumferential surface of the fixing belt 61 and is arranged to be close to, but not to be in contact with the inner circumferential surface of the fixing belt 61 so as to have a predetermined gap (0.5 to 1.5 mm, for example) with the inner circumferential surface of the fixing belt 61. The reason for arranging the temperature-sensitive magnetic member 64 so as to be close to the fixing belt 61 is to achieve a configuration in which the temperature of the temperature-sensitive magnetic member 64 changes in accordance with the temperature of the fixing belt 61, that is, the temperature of the temperature-sensitive magnetic member 64 becomes substantially equal to the temperature of the fixing belt 61.

In addition, the reason for arranging the temperature-sensitive magnetic member 64 so as not to be in contact with the fixing belt 61 is to suppress heat of the fixing belt 61 flowing into the temperature-sensitive magnetic member 64 when the fixing belt 61 is self-heated up to the fixation setting temperature after the main switch of the image forming apparatus 1 is turned on, and thereby to achieve shortening of the warm up time.

Moreover, the temperature-sensitive magnetic member 64 is formed of a material whose "permeability change start temperature" (refer to later part of the description) at which the permeability of the magnetic properties drastically changes is not less than the fixation setting temperature at which each color toner image starts melting, and whose permeability change start temperature is also set within a temperature range lower than the heat-resistant temperatures of the elastic layer 613 and the surface release layer 614 of the fixing belt 61. Specifically, the temperature-sensitive magnetic member 64 is formed of a material having a property ("temperature-sensitive magnetic property") that reversibly changes between the ferromagnetic property and the non-magnetic property (paramagnetic property) in a temperature range including the fixation setting temperature. Thus, the temperature-sensitive magnetic member 64 functions as a magnetic path forming member that forms a magnetic path in the temperature-sensitive magnetic member 64. Further, within a temperature range not greater than the permeability change start temperature, where the temperature-sensitive magnetic member 64 has the ferromagnetic property, the temperature-sensitive magnetic member 64 induces magnetic field lines generated by the IH heater 80 and going through the fixing belt 61 to the inside thereof, and forms a magnetic path so that the magnetic field lines may pass through the inside of the temperature-sensitive magnetic member 64. Thereby, the temperature-sensitive magnetic member 64 forms a closed magnetic path that internally wraps the fixing belt 61 and an excitation coil 82 (refer to later-described FIG. 6) of the IH heater 80. Meanwhile, within a temperature range exceeding the permeability change start temperature, the temperature-sensitive magnetic member 64 causes the magnetic field lines generated by the IH heater 80 and going through the fixing belt 61 to go therethrough so as to run across the temperature-sensitive magnetic member 64 in the thickness direction of the temperature-sensitive magnetic member 64. Then, the magnetic field lines generated by the IH heater 80 and going through the fixing belt 61 form a magnetic path in which the magnetic field lines go through the temperature-sensitive magnetic member 64, and then pass through the inside of the induction member 66 and return to the IH heater 80.

Note that, the "permeability change start temperature" herein refers to a temperature at which a permeability (permeability measured by JIS C2531, for example) starts decreasing continuously and refers to a temperature point at which the amount of the magnetic flux (the number of magnetic field lines) going through a member such as the temperature-sensitive magnetic member 64 starts to change, for example. Accordingly, the permeability change start temperature is a temperature close to the Curie point, which is a temperature at which the magnetic property is lost, but is a temperature with a concept different from the Curie point.

Examples of the material of the temperature-sensitive magnetic member 64 include a binary temperature-sensitive magnetic alloy such as a Fe—Ni alloy (permalloy) or a ternary temperature-sensitive magnetic alloy such as a Fe—Ni—Cr alloy whose permeability change start temperature used as the fixation setting temperature is set within a range of 140 degrees C. to 240 degrees C. For example, the permeability change start temperature may be set around 225 degrees C. by setting the ratios of Fe and Ni at approximately 64% and 36% (atom number ratio), respectively, in a binary temperature-sensitive magnetic alloy of Fe—Ni. The aforementioned metal alloys or the like including the permalloy and the temperature-sensitive magnetic alloy are suitable for the temperature-sensitive magnetic member 64 since they are excellent in molding property and processability, and a high heat conductivity as well as less expensive costs. Another example of the material includes a metal alloy made of Fe, Ni, Si, B, Nb, Cu, Zr, Co, Cr, V, Mn, Mo or the like.

In addition, the temperature-sensitive magnetic member 64 is formed with a thickness larger than the skin depth δ (refer to the formula (1) described above) with respect to the AC magnetic field (magnetic field lines) generated by the IH heater 80. Specifically, a thickness of approximately 50 to 300 μm is set when a Fe—Ni alloy is used as the material, for example. Note that, the configuration and the function of the temperature-sensitive magnetic member 64 will be described later in detail.

<Description of Holder>

The holder 65 that supports the pressing pad 63 is formed of a material having a high rigidity so that the amount of deflection in a state where the pressing pad 63 receives pressing force from the pressure roll 62 may be a certain amount or less. In this manner, the amount of pressure (nip pressure N) at the nip portion N in the longitudinal direction is kept uniform. Moreover, since the fixing unit 60 of the present exemplary embodiment employs a configuration in which the fixing belt 61 is self-heated by use of electromagnetic induction, the holder 65 is formed of a material that provides no influence or hardly provides influence to an induction magnetic field, and that is not influenced or is hardly influenced by the induction magnetic field. For example, a heat-resistant resin such as glass mixed PPS (polyphenylene sulfide), or a non-magnetic metal material such as Al, Cu or Ag is used.

<Description of Induction Member>

The induction member 66 is formed into a circular arc shape corresponding with the inner circumferential surface of the temperature-sensitive magnetic member 64 and is arranged so as not to be in contact with the inner circumferential surface of the temperature-sensitive magnetic member 64. Here, the induction member 66 has a gap set in advance (1.0 to 5.0 mm, for example) with the inner circumferential surface of the temperature-sensitive magnetic member 64. The induction member 66 is formed of, for example, a non-magnetic metal such as Ag, Cu and Al having a relatively small specific resistance. When the temperature of temperature-sensitive magnetic member 64 increases to a temperature not less than the permeability change start temperature, the induction member 66 induces an AC magnetic field (magnetic field lines) generated at the IH heater 80 and thereby forms a state where an eddy current I is more easily generated in comparison with the conductive heat generating layer 612 of the fixing belt 61. For this reason, the thickness of the induction member 66 is formed to be a thickness set in advance (1.0 mm, for example) sufficiently larger than the skin depth δ (refer to the aforementioned formula (1)) so as to allow the eddy current I to easily flow therethrough.

<Description of Drive Mechanism of Fixing Belt>

Next, a description will be given of a drive mechanism of the fixing belt 61.

As shown in FIG. 2, which is a front view, end caps 67 are secured to both ends in the axis direction of the holder (refer to FIG. 3), respectively. The end caps 67 rotationally drive the fixing belt 61 in a circumferential direction while keeping cross sectional shapes of both ends of the fixing belt 61 in a circular shape. Then, the fixing belt 61 directly receives rotational drive force via the end caps 67 at the both ends and rotationally moves at, for example, a process speed of 140 mm/s in a direction of an arrow C in FIG. 3

Figure 5A:
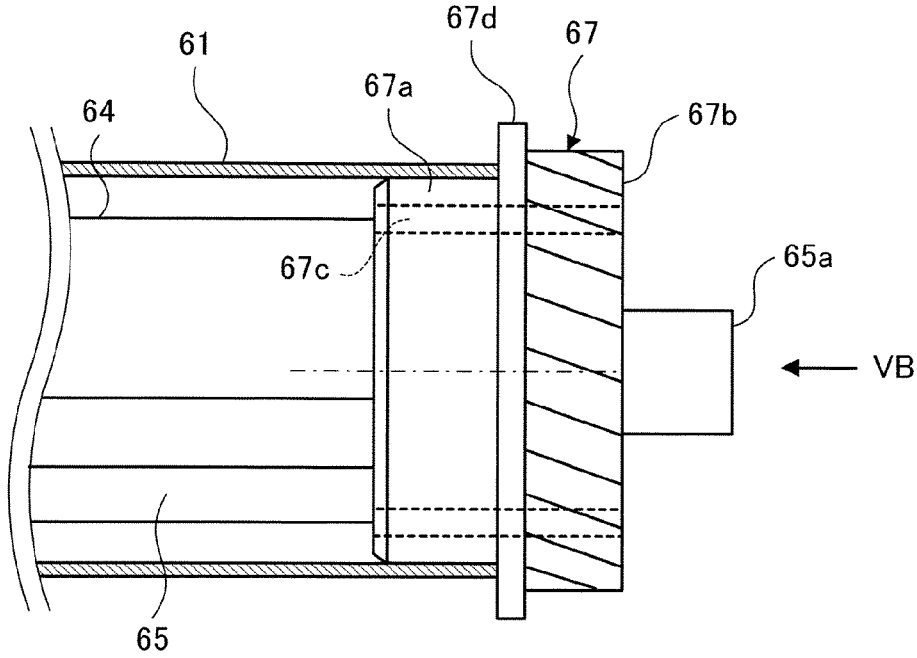
FIG. 5A is a side view of one of the end caps.
Figure 5B:
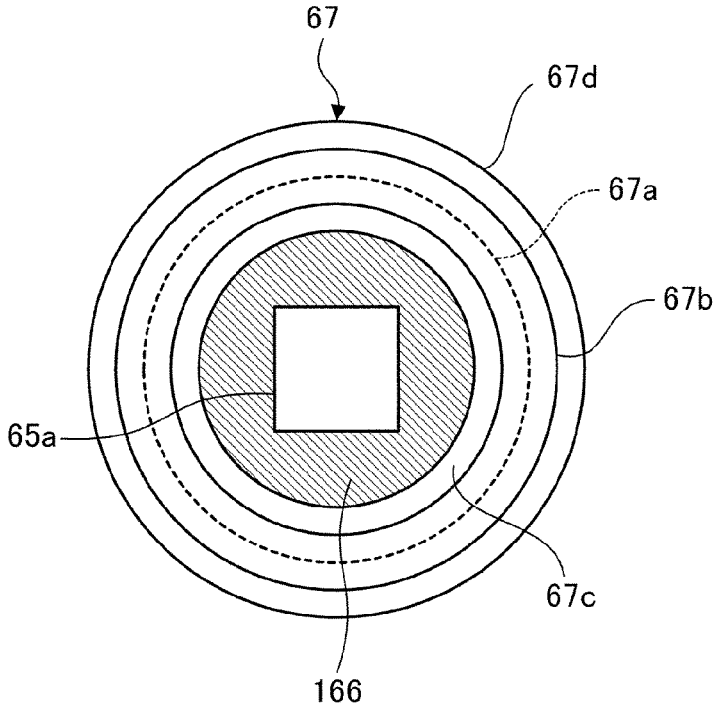
FIG. 5B is a plain view of the end cap when viewed from a VB direction.

Here, FIG. 5A is a side view of one of the end caps 67, and FIG. 5B is a plain view of the end cap 67 when viewed from a VB direction of FIG. 5A. As shown in FIGS. 5A and 5B, the end cap 67 includes: a fixing unit 67*a* that is fitted into the inside of a corresponding one of the ends of the fixing belt 61 and that has a cross section formed into a circular shape; a flange 67*d* that has an outer diameter formed larger than that of the fixing unit 67*a* and that is formed so as to project from the fixing belt 61 in the radial direction when attached to the fixing belt 61; a gear 67*b* to which the rotational drive force is transmitted; and a bearing unit 67*c* that is rotatably connected to a support member 65*a* formed at a corresponding one of the ends of the holder 65 with a connection member 166 interposed therebetween. Then, as shown in FIG. 2, the support members 65*a* at the both ends of the holder 65 are secured onto the both ends of a chassis 69 of the fixing unit 60, respectively, thereby, supporting the end caps 67 so as to be rotatable with the bearing units 67*c* respectively connected to the support members 65*a*.

As the material of the end caps 67, so called engineering plastics having a high mechanical strength or heat-resistant properties is used. For example, a phenol resin, polyimide resin, polyamide resin, polyamide-imide resin, PEEK resin, PES resin, PPS resin, LCP resin or the like are suitable.

Then, as shown in FIG. 2, in the fixing unit 60, rotational drive force from a drive motor 90 is transmitted to a shaft 93 via transmission gears 91 and 92. The rotational drive force is then transmitted from transmission gears 94 and 95 connected to the shaft 93 to the gears 67*b* of the respective end caps 67 (refer to FIGS. 5A and 5B). Thereby, the rotational drive force is transmitted from the end caps 67 to the fixing belt 61, and the end caps 67 and the fixing belt 61 are integrally driven to rotate.

As described above, the fixing belt 61 directly receives the drive force at the both ends of the fixing belt 61 to rotate, thereby rotating stably.

Here, a torque of approximately 0.1 to 0.5 N·m is generally exerted when the fixing belt 61 directly receives the drive force from the end caps 67 at the both ends thereof and then rotates. However, in the fixing belt 61 of the present exemplary embodiment, the base layer 611 is formed of, for example, a non-magnetic stainless steel having a high mechanical strength. Thus, buckling or the like does not easily occur on the fixing belt 61 even when a torsional torque of approximately 0.1 to 0.5 N·m is exerted on the entire fixing belt 61.

In addition, the fixing belt 61 is prevented from inclining or leaning to one direction by the flanges 67*d* of the end caps 67, but at this time, compressive force of approximately 1 to 5 N is exerted toward the axis direction from the ends (flanges 67*d*) on the fixing belt 61 in general. However, even in a case where the fixing belt 61 receives such compressive force, the occurrence of buckling or the like is prevented since the base layer 611 of the fixing belt 61 is formed of a non-magnetic stainless steel or the like.

As described above, the fixing belt 61 of the present exemplary embodiment receives the drive force directly at the both ends of the fixing belt 61 to rotate, thereby, rotating stably. In addition, the base layer 611 of the fixing belt 61 is formed of, for example, a non-magnetic stainless steel or the like having a high mechanical strength, hence providing the configuration in which buckling or the like caused by a torsion torque or compressive force does not easily occur in this case. Moreover, the softness and flexibility of the entire fixing belt 61 is obtained by forming the base layer 611 and the conductive heat-generating layer 612 respectively as thin layers, so that the fixing belt 61 is deformed so as to correspond with the nip portion N and recovers to the original shape.

With reference back to FIG. 3, the pressure roll 62 is arranged to face the fixing belt 61 and rotates at, for example, a process speed of 140 mm/s in the direction of the arrow D in FIG. 3 while being driven by the fixing belt 61. Then, the nip portion N is formed in a state where the fixing belt 61 is held between the pressure roll 62 and the pressing pad 63. Then, while the sheet P holding an unfixed toner image is caused to pass through this nip portion N, heat and pressure are applied to the sheet P, and thereby, the unfixed toner image is fixed onto the sheet P.

The pressure roll 62 is formed of a multi-layer including: a solid aluminum core (cylindrical core metal) 621 having a diameter of 18 mm, for example; a heat-resistant elastic layer 622 that covers the outer circumferential surface of the core 621, and that is made of silicone sponge having a thickness of 5 mm, for example; and a release layer 623 that is formed of a heat-resistant resin such as PFA containing carbon or the like, or a heat-resistant rubber, having a thickness of 50 μm, for example, and that covers the heat-resistant elastic layer 622. Then, the pressing pad 63 is pressed under a load of 25 kgf for example, by pressing springs 68 (refer to FIG. 2) with the fixing belt 61 therebetween.

<Description of IH Heater>

Next, a description will be given of the IH heater 80 that induces the heat generation of the fixing belt 61 by electromagnetic induction by action of an AC magnetic field in the conductive heat-generating layer 612 of the fixing belt 61.

Figure 6:
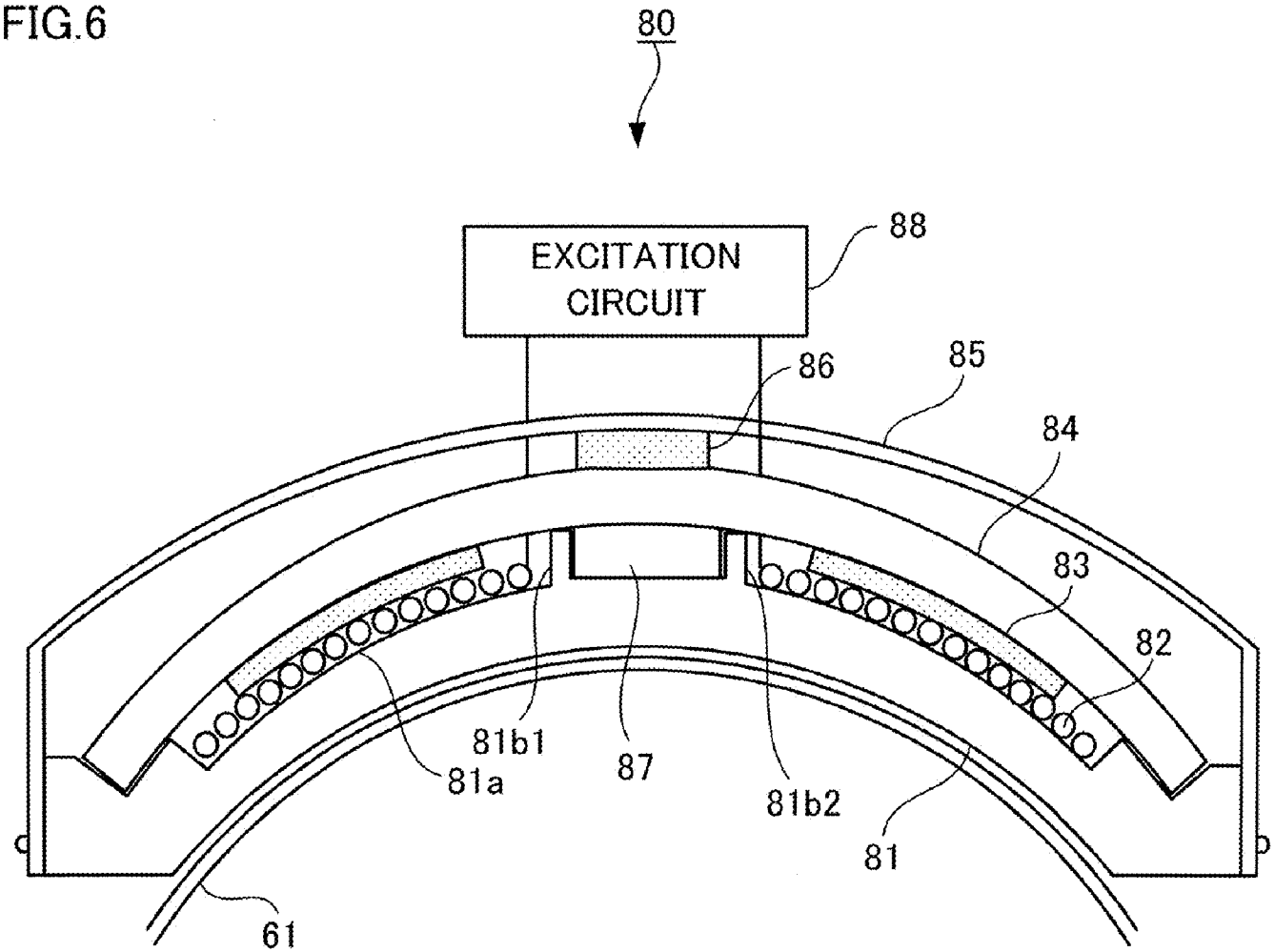
FIG. 6 is a cross sectional view for explaining a configuration of the IH heater.

FIG. 6 is a cross sectional view for explaining a configuration of the IH heater 80 of the exemplary embodiment. As shown in FIG. 6, the IH heater 80 includes: a support member 81 that is formed of a non-magnetic material such as a heat-resistant resin, for example; and the excitation coil 82 that generates the AC magnetic field. Moreover, the IH heater 80 includes: elastic support members 83 each of which is formed of an elastic material and secures the excitation coil 82 onto the support member 81; and multiple magnetic cores 84 that are arranged along the width direction of the fixing belt 61 and that form a magnetic path of the AC magnetic field generated by the excitation coil 82. Further, the IH heater 80 includes multiple adjustment magnetic cores 87 that are arranged along the width direction of the fixing belt 61 and that make the AC magnetic field generated by the excitation coil 82 uniform in the longitudinal direction of the support member 81. Furthermore, the IH heater 80 includes: a shield 85 that shields a magnetic field; a pressing member 86 that presses the magnetic cores 84 toward the support member 81; and an excitation circuit 88 that supplies an AC current (electric power) to the excitation coil 82.

The support member 81 is formed into a shape in which the cross section thereof is curved along the shape of the surface of the fixing belt 61, and is formed so as to keep a gap set in advance (0.5 to 2 mm, for example) between an upper surface (supporting surface) 81*a* that supports the excitation coil 82 and the surface of the fixing belt 61. In addition, examples of the material that forms the support member 81 include a heat-resistant non-magnetic material such as: a heat-resistant glass; a heat-resistant resin including polycarbonate, polyethersulphone or PPS (polyphenylene sulfide); and the heat-resistant resin containing a glass fiber therein.

The excitation coil 82 is formed by winding a litz wire in a closed loop of an oval shape, elliptical shape or rectangular shape having an opening inside, the litz wire being obtained by bundling 90 pieces of mutually isolated copper wires each having a diameter of 0.17 mm, for example. Then, when an AC current having a frequency set in advance is supplied from the excitation circuit 88 to the excitation coil 82, an AC magnetic field on the litz wire wound in a closed loop shape as the center is generated around the excitation coil 82. In general, a frequency of 20 kHz to 100 kHz, which is generated by the aforementioned general-purpose power supply, is used for the frequency of the AC current supplied to the excitation coil 82 from the excitation circuit 88.

The elastic support member 83 is a sheet-like elastic member formed of an elastic material such as a silicone rubber and a fluorine rubber, for example. The elastic support member 83 is arranged so as to press the excitation coil 82 against the supporting surface 81*a* of the support member 81. Thereby, the elastic support member 83 secures the excitation coil 82 in close contact with the supporting surface 81*a* of the support member 81.

As the material of each of the magnetic cores 84, a ferromagnetic material that is formed into a circular arc shape, and that is formed of an oxide or alloy material with a high permeability, such as a calcined ferrite, a ferrite resin, a non-crystalline alloy (amorphous alloy), permalloy or a temperature-sensitive magnetic alloy is used. The magnetic core 84 functions as a magnetic path. The magnetic core 84 induces, to the inside thereof, the magnetic field lines (magnetic flux) of the AC magnetic field generated at the excitation coil 82, and forms a path (magnetic path) of the magnetic field lines in which the magnetic field lines from the magnetic core 84 run across the fixing belt 61 to be directed to the temperature-sensitive magnetic member 64, then pass through the inside of the temperature-sensitive magnetic member 64, and return to the magnetic core 84. Specifically, a configuration in which the AC magnetic field generated at the excitation coil 82 passes through the inside of the magnetic core 84 and the inside of the temperature-sensitive magnetic member 64 is employed, and thereby, a closed magnetic path where the magnetic field lines internally wrap the fixing belt 61 and the excitation coil 82 is formed. Thereby, the magnetic field lines of the AC magnetic field generated at the excitation coil 82 are concentrated at a region of the fixing belt 61, which faces the magnetic core 84.

Here, the material of the magnetic cores 84 may be one that has a small amount of loss due to the forming of the magnetic path. Specifically, the magnetic cores 84 may be particularly used in a form that reduces the amount of eddy-current loss (shielding or dividing of the electric current path by having a slit or the like, or bundling of thin plates, or the like). In addition, the magnetic cores 84 may be particularly formed of a material having a small hysteresis loss.

The length of the magnetic core 84 along the rotation direction of the fixing belt 61 is formed so as to be shorter than the length of the temperature-sensitive magnetic member 64 along the rotation direction of the fixing belt 61. Thereby, the amount of leakage of the magnetic field lines toward the periphery of the IH heater 80 is reduced, resulting in improvement in the power factor. Moreover, the electromagnetic induction toward the metal materials forming the fixing unit 60 is also suppressed and the heat-generating efficiency at the fixing belt 61 (conductive heat-generating layer 612) increases.

Each of the magnetic cores 84 is supported by a pair of magnetic core supporting units (convex portions) 81*b*1 and 81*b*2 that are arranged at the center of the supporting surface 81*a*.

As the material of each of the adjustment magnetic cores 87, a rectangular solid shaped (block shaped) ferromagnetic material formed of an oxide or an alloy material having a high permeability such as a calcinated ferrite, a ferrite resin, a non-crystalline alloy (amorphous alloy), permalloy or a magnetism-adjusted steel is used. The adjustment magnetic core 87 functions as a magnetic field adjustment member that makes the magnetic field intensity in the longitudinal direction of the support member 81 averaged in the AC magnetic field formed by the magnetic cores 84 and the temperature-sensitive magnetic member 64, which are arranged around the excitation coil 82. The non-uniformity of the temperature in the width direction of the fixing belt 61 is reduced when the magnetic field intensity generated in the longitudinal direction of the support member 81 is made to be averaged. The adjustment magnetic core 87 is arranged at space of an inner region formed between the magnetic core supporting units 81*b*1 and 81*b*2 (region surrounded by inner walls of the magnetic core supporting units 81*b*1 and 81*b*2).

Figure 7:
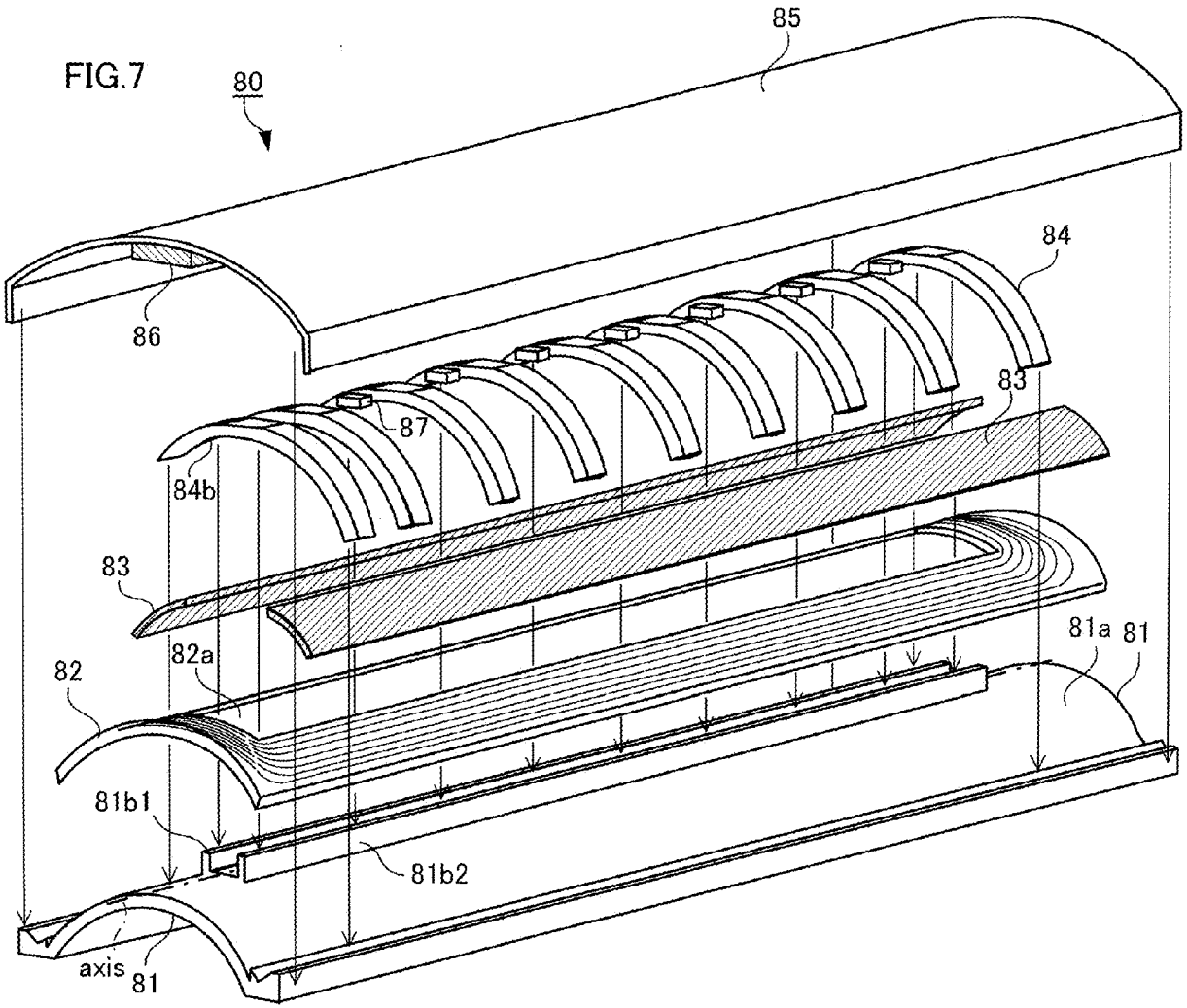
FIG. 7 is a diagram for explaining a multi-layer structure of the IH heater.

FIG. 7 is a diagram for explaining a multi-layer structure of the IH heater 80 in the exemplary embodiment. As shown in FIG. 7, the excitation coil 82 is arranged on the supporting surface 81*a* of the support member 81 so that a closed loop hollow 82*a* of the excitation coil 82 may surround the pair of the magnetic core supporting units (convex portions) 81*b*1 and 81*b*2 arranged in parallel along the center axis in the longitudinal direction of the supporting surface 81*a*. The supporting surface 81*a* is formed as a position setting surface whose gap with the fixing belt 61 that rotationally moves in a substantially circular orbit is set at a defined value (design value). The excitation coil 82 is pressed by the elastic support member 83 against the supporting surface 81*a* of the support member 81, thereby, being secured to be in close contact onto the supporting surface 81*a*.

Moreover, each of the multiple magnetic cores 84 arranged along the width direction of the fixing belt 61 has an inner circumferential surface 84*b*, which is formed into a circular arc shape on the excitation coil 82 side in the moving direction of the fixing belt 61. In addition, the inner circumferential surface 84*b* of the magnetic core 84 is formed with a length in the moving direction of the fixing belt 61 to cover (wrap) an entire region where the excitation coil 82 is arranged. Moreover, the inner circumferential surface 84*b* of each of the magnetic cores 84 is supported by a pair of magnetic core supporting units 81*b*1 and 81*b*2 arranged in parallel along the center axis in the longitudinal direction on the supporting surface 81*a*, and thereby, a gap between each of the magnetic cores 84 and the supporting surface 81*a* is set to be kept constant.

Each of the elastic support members 83 is formed of a sheet-like elastic material, such as a silicone rubber and a fluorine rubber, having a low Young's modulus, for example. The sheet-like elastic support members 83 are arranged between the excitation coil 82 and the magnetic cores 84. When the inner circumferential surfaces 84*b* of the magnetic cores 84 are supported by the pair of the magnetic core supporting units 81*b*1 and 81*b*2 on the supporting surface 81*a*, the gap between each of the magnetic cores 84 and the supporting surface 81*a* is set at a gap set in advance (also refer to FIG. 6). In this case, the thickness of the each of the elastic support members 83 is formed to be larger than the gap between each of the magnetic cores 84 and the supporting surface 81*a*. Meanwhile, when the shield 85 is attached onto the support member 81, each of the magnetic cores 84 is pressed toward the support member 81 by the pressing member 86 provided at the bottom surface of the shield 85. Thereby, the elastic support members 83 receive pressing force toward the support member 81 side via the magnetic cores 84, and then are elastically deformed (compressed). The elastically deformed elastic support members 83 press the excitation coil 82 against the supporting surface 81*a* by the elastic force generated therefrom. In this manner, the excitation coil 82 is brought into close contact with the supporting surface 81*a* and secured thereto by the elastic support members 83. Since the supporting surface 81*a* is formed and set so as to keep a gap set in advance (design value) with the surface of the fixing belt 61, the excitation coil 82 is set so as to keep a gap set in advance between the entire excitation coil 82 and the surface of the fixing belt 61. Here, even when the number of accumulations of the vibration of the excitation coil 82 grows larger because of the accumulated use of the fixing unit 60 for a long period of time, peeling does not occur between the elastic support members 83 and the excitation coil 82, and the positional relationship between the support member 81 and the excitation coil 82, which is set by default, is maintained.

Note that, in addition to an elastic material such as a silicone rubber or a fluorine rubber, an elastic member such as a spring may be used as the pressing member 86.

Subsequently, each of the magnetic cores 84 arranged along the width direction of the fixing belt 61 in the state where the inner circumferential surface 84*b* is supported on the pair of the magnetic core supporting units 81*b*1 and 81*b*2 is pressed toward the support member 81 from the top portion thereof by the pressing member 86 provided at the bottom surface of the shield 85. Then, each of the magnetic cores 84 is pressed so as to be held between the pressing member 86 arranged at the top surface side of the magnetic core 84 and the elastic support members 83 arranged at the bottom surface side thereof. In this manner, the vertical direction of the magnetic cores 84 in the IH heater 80 is secured.

Each of the multiple adjustment magnetic cores 87 arranged along the width direction of the fixing belt 61 is formed in a rectangular solid shape (block shape), and arranged between adjacent two of the magnetic cores 84 in space formed at the inner region between the magnetic core supporting units 81*b*1 and 81*b*2. The adjustment magnetic cores 87 are pressed against the support member 81 from the top portion thereof by the pressing member 86 provided at the bottom surface of the shield 85. Accordingly, each of the adjustment magnetic cores 87 is pressed so as to be held between the pressing member 86 at the top portion thereof and the inner region between the magnetic core supporting units 81*b*1 and 81*b*2 at the bottom portion thereof. Each of the adjustment magnetic cores 87 is thereby secured at the inner region between the magnetic core supporting units 81*b*1 and 81*b*2.

<Description of a State in which Fixing Belt Generates Heat>

Next, a description will be given of a state in which the fixing belt 61 generates heat by use of the AC magnetic field generated by the IH heater 80.

Firstly, as described above, the permeability change start temperature of the temperature-sensitive magnetic member 64 is set within a temperature range (140 to 240 degrees C., for example) where the temperature is not less than the fixation setting temperature for fixing color toner images and not greater than the heat-resistant temperature of the fixing belt 61. Then, when the temperature of the fixing belt 61 is not greater than the permeability change start temperature, the temperature of the temperature-sensitive magnetic member 64 near the fixing belt 61 corresponds to the temperature of the fixing belt 61 and then becomes equal to or lower than the permeability change start temperature. For this reason, the temperature-sensitive magnetic member 64 has a ferromagnetic property at this time, and thus, the magnetic field lines H of the AC magnetic field generated by the IH heater 80 form a magnetic path where the magnetic field lines H go through the fixing belt 61 and thereafter, pass through the inside of the temperature-sensitive magnetic member 64 along a spreading direction. Here, the "spreading direction" refers to a direction orthogonal to the thickness direction of the temperature-sensitive magnetic member 64.

Figure 8:
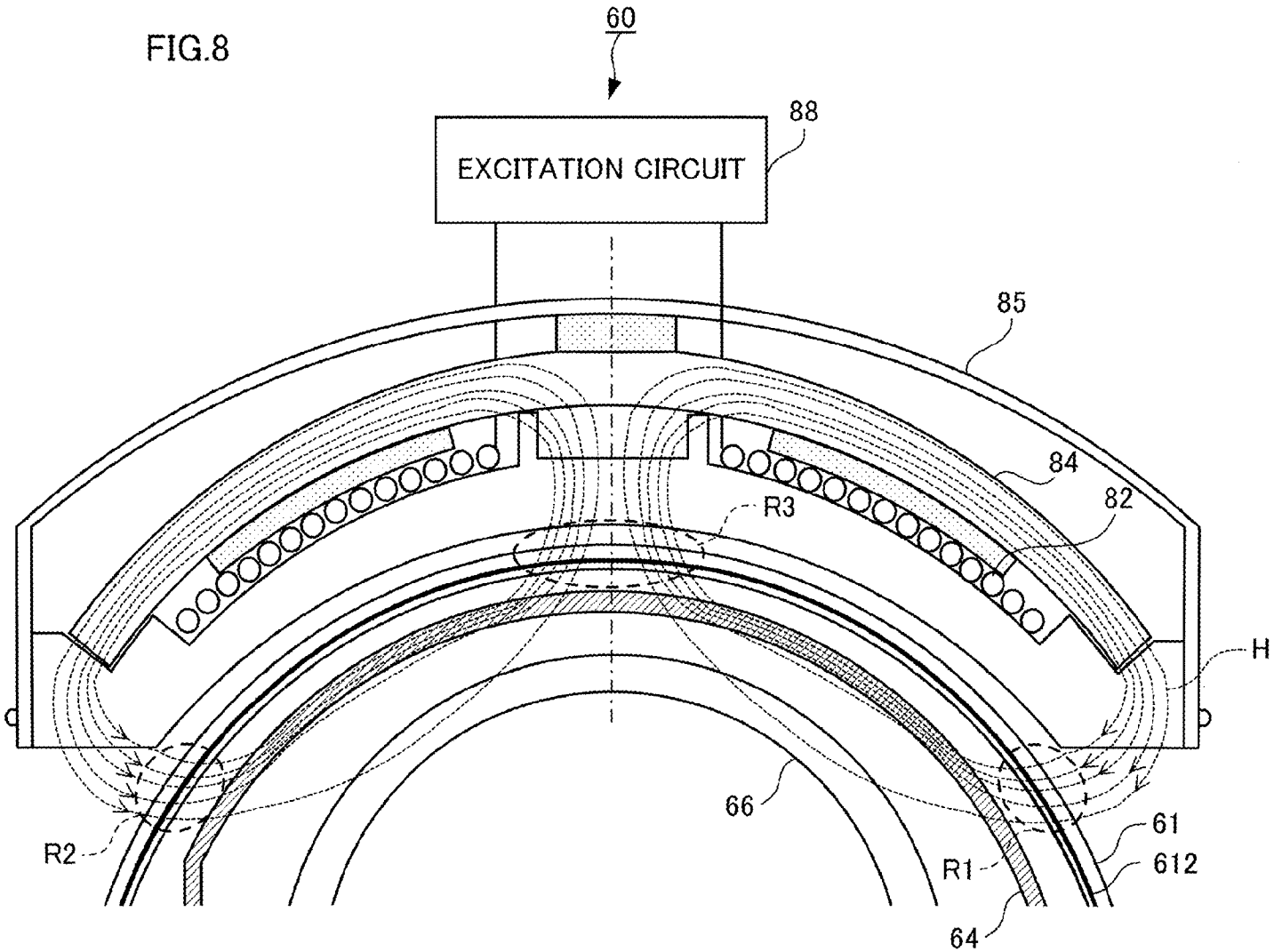
FIG. 8 is a diagram for explaining the state of the magnetic field lines in a case where the temperature of the fixing belt is within a temperature range not greater than the permeability change start temperature.

FIG. 8 is a diagram for explaining the state of the magnetic field lines H in a case where the temperature of the fixing belt 61 is within the temperature range not greater than the permeability change start temperature. As shown in FIG. 8, in the case where the temperature of the fixing belt 61 is within the temperature range not greater than the permeability change start temperature, the magnetic field lines H of the AC magnetic field generated by the IH heater 80 form a magnetic path where the magnetic field lines H go through the fixing belt 61, and then pass through the inside of the temperature-sensitive magnetic member 64 in the spreading direction (direction orthogonal to the thickness direction). Accordingly, the number of the magnetic field lines H (density of magnetic flux) in unit area in the region where the magnetic field lines H run across the conductive heat-generating layer 612 of the fixing belt 61 becomes large.

Specifically, after the magnetic field lines H are radiated from the magnetic cores 84 of the IH heater 80 and pass through regions R1 and R2 where the magnetic field lines H run across the conductive heat-generating layer 612 of the fixing belt 61, the magnetic field lines H are induced to the inside of the temperature-sensitive magnetic member 64, which is a ferromagnetic member. For this reason, the magnetic field lines H running across the conductive heat-generating layer 612 of the fixing belt 61 in the thickness direction are concentrated so as to enter the inside of the temperature-sensitive magnetic member 64. Accordingly, the magnetic flux density becomes high in the regions R1 and R2. In addition, in a case where the magnetic field lines H passing through the inside of the temperature-sensitive magnetic member 64 along the spreading direction return to the magnetic core 84, in a region R3 where the magnetic field lines H run across the conductive heat-generating layer 612 in the thickness direction, the magnetic field lines H are generated toward the magnetic core 84 in a concentrated manner from a portion, where the magnetic potential is low, of the temperature-sensitive magnetic member 64. For this reason, the magnetic field lines H running across the conductive heat-generating layer 612 of the fixing belt 61 in the thickness direction move from the temperature-sensitive magnetic member 64 toward the magnetic core 84 in a concentrated manner, so that the magnetic flux density in the region R3 becomes high as well.

In the conductive heat-generating layer 612 of the fixing belt 61 which the magnetic field lines H run across in the thickness direction, the eddy current I proportional to the amount of change in the number of the magnetic field lines H per unit area (magnetic flux density) is generated. Thereby, as shown in FIG. 8, a larger eddy current I is generated in the regions R1, R2 and R3 where a large amount of change in the magnetic flux density occurs. The eddy current I generated in the conductive heat-generating layer 612 generates a Joule heat W ($W=I^2R$), which is multiplication of the specific resistant value R and the square of the eddy current I of the conductive heat-generating layer 612. Accordingly, a large Joule heat W is generated in the conductive heat-generating layer 612 where the larger eddy current I is generated.

As described above, in a case where the temperature of the fixing belt 61 is within the temperature range not greater than the permeability change start temperature, a large amount of heat is generated in the regions R1, R2 and R3 where the magnetic field lines H run across the conductive heat-generating layer 612, and thereby the fixing belt 61 is self-heated.

Incidentally, in the fixing unit 60 of the present exemplary embodiment, the temperature-sensitive magnetic member 64 is arranged at the inner circumferential surface side of the fixing belt 61 while arranged to be close to the fixing belt 61, thereby, providing the configuration in which the magnetic core 84 inducing the magnetic field lines H generated at the excitation coil 82 to the inside thereof, and the temperature-sensitive magnetic member 64 inducing the magnetic field lines H running across and going through the fixing belt 61 in the thickness direction are arranged to be close to each other. For this reason, the AC magnetic field generated by the IH heater 80 (excitation coil 82) forms a loop of a short magnetic path, so that the magnetic flux density and the degree of magnetic coupling in the magnetic path increase. Thereby, heat is more efficiently generated in the fixing belt 61 in a case where the temperature of the fixing belt 61 is within the temperature range not greater than the permeability change start temperature.

<Description of Function for Suppressing Increase in Temperature of Non-sheet Passing Portion of Fixing Belt>

Next, a description will be given of a function for suppressing an increase in the temperature of a non-sheet passing portion of the fixing belt 61.

Figure 9:
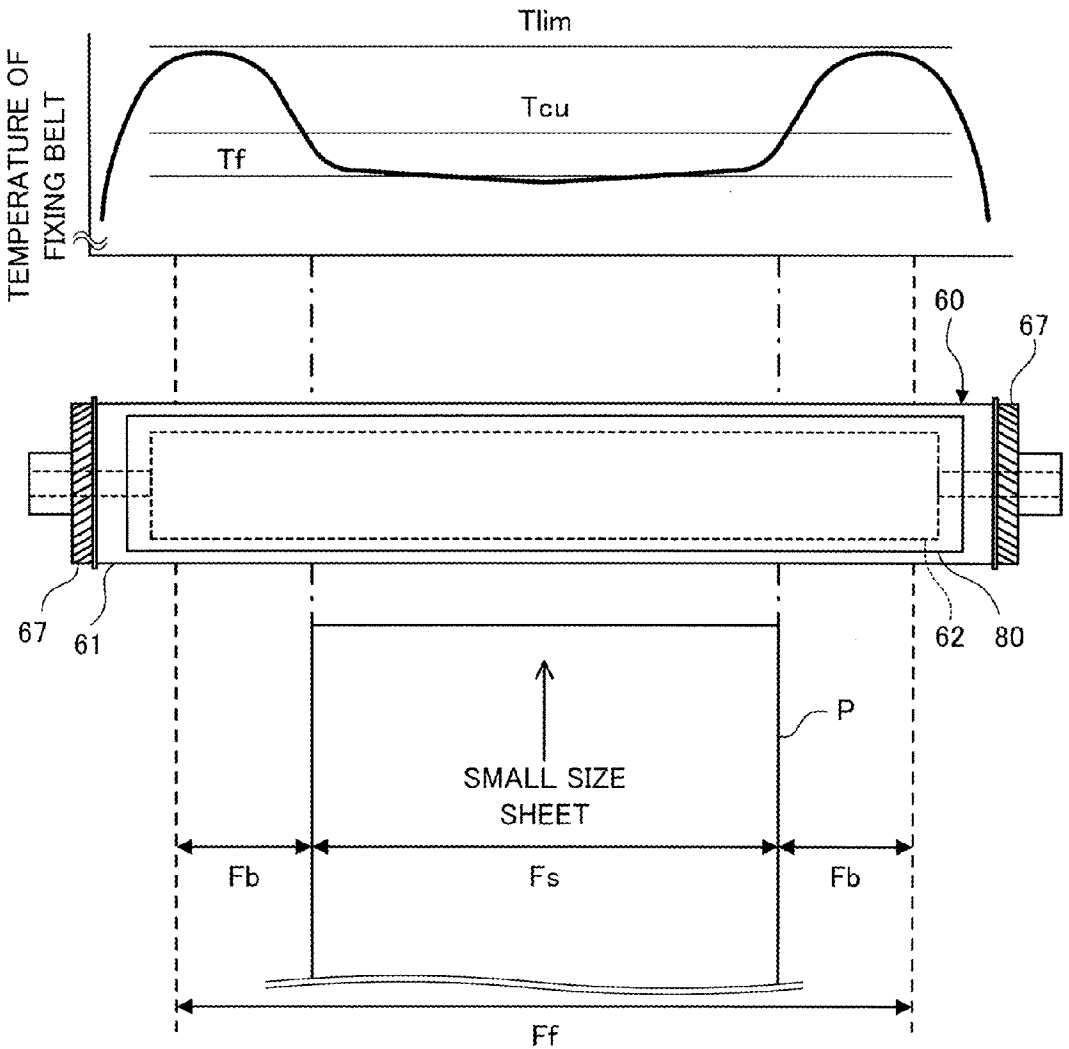
FIG. 9 is a diagram showing a summary of a temperature distribution in the width direction of the fixing belt when the small size sheets are successively inserted into the fixing unit.

Firstly, a description will be given herein of a case where sheets P of a small size (small size sheets P1) are successively inserted into the fixing unit 60. FIG. 9 is a diagram showing a summary of a temperature distribution in the width direction of the fixing belt 61 when the small size sheets P1 are successively inserted into the fixing unit 60. In FIG. 9, Ff denotes a maximum sheet passing region, which is the width (A3 long side, for example) of the maximum size of a sheet P used in the image forming apparatus 1, Fs denotes a region through which the small size sheet P1 (A4 longitudinal feed, for example) having a smaller horizontal width than that of a maximum size sheet P passes, and Fb denotes a non-sheet passing region through which no small size sheet P1 passes. Note that, sheets are inserted into the image forming apparatus 1 with the center position thereof as the reference point.

As shown in FIG. 9, when the small size sheets P1 are successively inserted into the fixing unit 60, the heat for fixing is consumed at the small size sheet passing region Fs where each of the small size sheets P1 passes. For this reason, the controller 31 (refer to FIG. 1) performs a temperature adjustment control with a fixation setting temperature, so that the temperature of the fixing belt 61 at the small size sheet passing region Fs is maintained within a range near the fixation setting temperature. Meanwhile, at the non-sheet passing regions Fb as well, the same temperature adjustment control as that performed for the small size sheet passing region Fs is performed. However, the heat for fixing is not consumed at the non-sheet passing regions Fb. For this reason, the temperature of the non-sheet passing regions Fb easily increases to a temperature higher than the fixation setting temperature. Then, when the small size sheets P1 are successively inserted into the fixing unit 60 in this state, the temperature of the non-sheet passing regions Fb increases to a temperature higher than the heat-resistant temperature of the elastic layer 613 or the surface release layer 614 of the fixing belt 61, hence deteriorating the fixing belt 61 in some cases.

In this respect, as described above, in the fixing unit 60 of the present exemplary embodiment, the temperature-sensitive magnetic member 64 is formed of, for example, a Fe—Ni alloy or the like whose permeability change start temperature is set within a temperature range not less than the fixation setting temperature and not greater than the heat-resistant temperature of the elastic layer 613 or the surface release layer 614 of the fixing belt 61. Specifically, as shown in FIG. 9, a permeability change start temperature Tcu of the temperature-sensitive magnetic member 64 is set within a temperature range not less than a fixation setting temperature Tf and not greater than a heat-resistant temperature Tlim of, for example, the elastic layer 613 or the surface release layer 614 of the fixing belt 61.

Thus, when the small size sheets P1 are successively inserted into the fixing unit 60, the temperature of the non-sheet passing regions Fb of the fixing belt 61 exceeds the permeability change start temperature of the temperature-sensitive magnetic member 64. Accordingly, the temperature of the temperature-sensitive magnetic member 64 near the fixing belt 61 at the non-sheet passing regions Fb also exceeds the permeability change start temperature in response to the temperature of the fixing belt 61 as in the case of the fixing belt 61. For this reason, the relative permeability of the temperature-sensitive magnetic member 64 at the non-sheet passing regions Fb becomes close to 1, so that the temperature-sensitive magnetic member 64 at the non-sheet passing regions Fb loses ferromagnetic properties. Since the relative permeability of the temperature-sensitive magnetic member 64 decreases and becomes closer to 1, the magnetic field lines H at the non-sheet passing regions Fb are no longer induced to the inside of the temperature-sensitive magnetic member 64, and start going through the temperature-sensitive magnetic member 64. For this reason, in the fixing belt 61 at the non-sheet passing regions Fb, the magnetic field lines H spread after passing through the conductive heat-generating layer 612, hence leading to a decrease in the density of magnetic flux of the magnetic field lines H running across the conductive heat-generating layer 612. Thereby, the amount of an eddy current I generated at the conductive heat-generating layer 612 decreases, and then, the amount of heat (Joule heat W) generated at the fixing belt 61 decreases. As a result, an excessive increase in the temperature at the non-sheet passing regions Fb is suppressed, and the fixing belt 61 is prevented from being damaged.

As described above, the temperature-sensitive magnetic member 64 functions as a detector that detects the temperature of the fixing belt 61 and also functions as a temperature increase suppresser that suppresses an excessive increase in the temperature of the fixing belt 61 in accordance with the detected temperature of the fixing belt 61, at a time.

The magnetic field lines H after passing through the temperature-sensitive magnetic member 64 arrive at the induction member 66 (refer to FIG. 3) and then are induced to the inside thereof. When the magnetic flux arrives at the induction member 66 and then is induced to the inside thereof, a large amount of the eddy current I flows into the induction member 66, into which the eddy current I flows more easily than into the conductive heat-generating layer 612. Thus, the amount of eddy current flowing into the conductive heat-generating layer 612 is further suppressed, so that an increase in the temperature at the non-sheet passing regions Fb is suppressed.

At this time, the thickness, material and shape of the induction member 66 are selected in order that the induction member 66 may induce most of the magnetic field lines H from the excitation coil 82 and the magnetic field lines H may be prevented from leaking from the fixing unit 60. Specifically, the induction member 66 is formed of a material having a sufficiently large thickness of the skin depth δ. Thereby, even when the eddy current I flows into the induction member 66, the amount of heat to be generated is extremely small. In the present exemplary embodiment, the induction member 66 is formed of Al (aluminum), with a thickness of 1 mm, of a substantially circular arc shape along the temperature-sensitive magnetic member 64. The induction member 66 is also arranged so as not to be in contact with the temperature-sensitive magnetic member 64 (average distance therebetween is 4 mm, for example). As another example of the material, Ag or Cu may be particularly used.

Incidentally, when the temperature of the fixing belt 61 at the non-sheet passing regions Fb becomes lower than the permeability change start temperature of the temperature-sensitive magnetic member 64, the temperature of the temperature-sensitive magnetic member 64 at the non-sheet passing regions Fb also becomes lower than the permeability change start temperature thereof. For this reason, the temperature-sensitive magnetic member 64 becomes ferromagnetic again, and the magnetic field lines H are induced to the inside of the temperature-sensitive magnetic member 64. Thus, a large amount of the eddy current I flows into the conductive heat-generating layer 612. For this reason, the fixing belt 61 is again self-heated.

Figure 10:
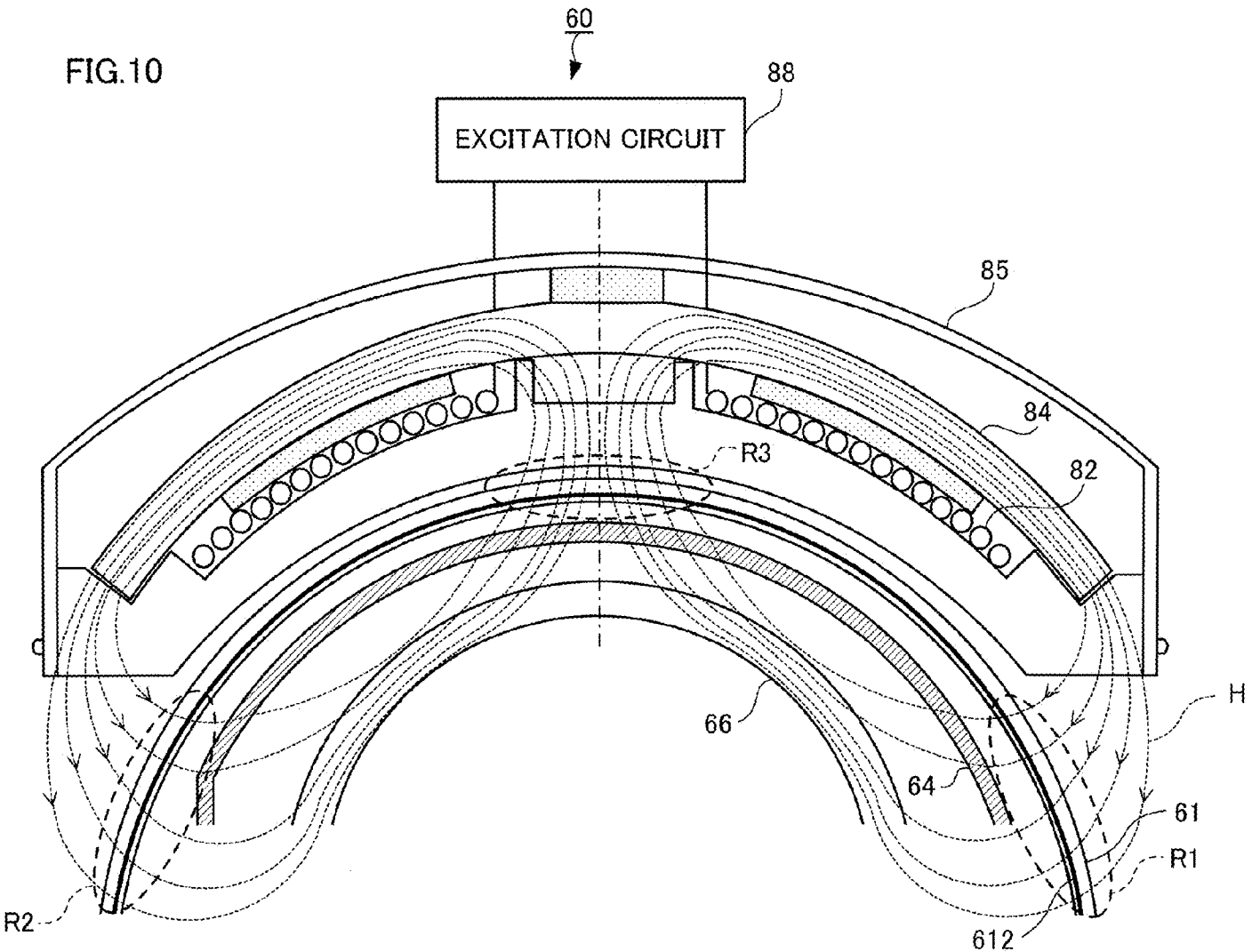
FIG. 10 is a diagram for explaining a state of the magnetic field lines when the temperature of the fixing belt at the non-sheet passing regions is within a temperature range exceeding the permeability change start temperature.

FIG. 10 is a diagram for explaining a state of the magnetic field lines H when the temperature of the fixing belt at the non-sheet passing regions Fb is within the temperature range exceeding the permeability change start temperature. As shown in FIG. 10, when the temperature of the fixing belt 61 at the non-sheet passing regions Fb is within the temperature range exceeding the permeability change start temperature, the relative permeability of the temperature-sensitive magnetic member 64 at the non-sheet passing regions Fb decreases. For this reason, the magnetic field lines H of the AC current generated by the IH heater 80 changes so as to easily go through the temperature-sensitive magnetic member 64. Thereby, the magnetic field lines H of the AC current generated by the IH heater 80 (excitation coil 82) are radiated from the magnetic cores 84 so as to spread toward the fixing belt 61 and arrive at the induction member 66.

Specifically, at the regions R1 and R2 where the magnetic field lines H are radiated from the magnetic cores 84 of the IH heater 80 and then run across the conductive heat-generating layer 612 of the fixing belt 61, since the magnetic field lines H are not easily induced to the temperature-sensitive magnetic member 64, the magnetic field lines H radially spread. Accordingly, the density of the magnetic flux of the magnetic field lines H (the number of the magnetic field lines H per unit area) running across the conductive heat-generating layer 612 of the fixing belt 61 in the thickness direction decreases. In addition, at the region R3 where the magnetic field lines H run across the conductive heat-generating layer 612 in the thickness direction when returning to the magnetic cores 84 again, the magnetic field lines H return to the magnetic cores 84 from the wide region where the magnetic field lines H spread, so that the density of the magnetic flux of the magnetic field lines H running across the conductive heat-generating layer 612 of the fixing belt 61 in the thickness direction decreases.

For this reason, when the temperature of the fixing belt 61 is within the temperature range exceeding the permeability change start temperature, the density of the magnetic flux of the magnetic field lines H running across the conductive heat-generating layer 612 in the thickness direction at the regions R1, R2 and R3 decreases. Accordingly, the amount of the eddy current I generated in the conductive heat-generating layer 612 where the magnetic field lines H run across in the thickness direction decreases, and the Joule heat W generated at the fixing belt 61 decreases. Therefore, the temperature of the fixing belt 61 decreases.

As described above, when the temperature of the fixing belt 61 at the non-sheet passing regions Fb is within a temperature range not less than the permeability change start temperature, the magnetic field lines H are not easily induced to the inside of the temperature-sensitive magnetic member 64 at the non-sheet passing regions Fb. Thus, the magnetic field lines H of the AC magnetic field generated by the excitation coil 82 spread and run across the conductive heat-generating layer 612 of the fixing belt 61 in the thickness direction. Accordingly, the magnetic path of the AC magnetic field generated by the excitation coil 82 forms a long loop, so that the density of magnetic flux in the magnetic path in which the magnetic field lines H pass through the conductive heat-generating layer 612 of the fixing belt 61 decreases.

Thereby, at the non-sheet passing regions Fb where the temperature thereof increases, for example, when the small size sheets P1 are successively inserted into the fixing unit 60, the amount of the eddy current I generated at the conductive heat-generating layer 612 of the fixing belt 61 decreases, and the amount of heat (Joule heat W) generated at the non-sheet passing regions Fb of the fixing belt 61 decreases. As a result, an excessive increase in the temperature of the non-sheet passing regions Fb is suppressed.

<Description of Configuration for Suppressing Increase in Temperature of Temperature-sensitive Magnetic Member>

In order for the temperature-sensitive magnetic member 64 to satisfy the aforementioned function to suppress an excessive increase in the temperature at the non-sheet passing regions Fb, the temperature of each region of the temperature-sensitive magnetic member 64 in the longitudinal direction needs to change in accordance with the temperature of each region of the fixing belt 61 in the longitudinal direction, which faces each region of the temperature-sensitive magnetic member 64 in the longitudinal direction, to satisfy the aforementioned function as a detector that detects the temperature of the fixing belt 61.

For this reason, as the configuration of the temperature-sensitive magnetic member 64, a configuration in which the temperature-sensitive magnetic member 64 is not easily subjected to induction heating by the magnetic field lines H is employed. Specifically, even when the temperature-sensitive magnetic member 64 is in a state of being ferromagnetic since the temperature of the fixing belt 61 is not greater than the permeability change start temperature, some of the magnetic field lines H that run across the temperature-sensitive magnetic member 64 in the thickness direction still exist in the magnetic field lines H from the IH heater 80. Thus, a weak eddy current I is generated inside the temperature-sensitive magnetic member 64, so that a small amount of heat is generated in the temperature-sensitive magnetic member 64 as well. For this reason, for example, in a case where a huge amount of image formation is successively performed, the heat generated by the temperature-sensitive magnetic member 64 is accumulated in itself, and the temperature of the temperature-sensitive magnetic member 64 at the sheet passing region (refer to FIG. 9) tends to increase. When the amount of the self-heating due to the eddy current loss in this manner is large, the temperature of the temperature-sensitive magnetic member 64 increases, and unintentionally reaches the permeability change start temperature. As a result, the magnetic characteristic difference between the sheet-passing region and the non-sheet passing regions no longer exists, and thus, the effect of suppressing a temperature increase becomes no longer effective. In this respect, in order to maintain the correspondence relationship between the respective temperatures of the temperature-sensitive magnetic member 64 and the fixing belt 61 and in order for the temperature-sensitive magnetic member 64 to function as the detector that detects the temperature of the fixing belt 61 with high accuracy, Joule heat W to be generated in the temperature-sensitive magnetic member 64 needs to be suppressed.

With this respect, firstly, a material having properties (specific resistance and permeability) not easily subjected to induction heating by the magnetic field lines H is selected as the material of the temperature-sensitive magnetic member 64 for the purpose of reducing an eddy current loss or hysteresis loss in the temperature-sensitive magnetic member 64.

Secondly, the thickness of the temperature-sensitive magnetic member 64 is formed to be larger than the skin depth δ in the state where the temperature-sensitive magnetic member 64 is ferromagnetic, in order that the magnetic field lines H may not easily run across the temperature-sensitive magnetic member 64 in the thickness direction when the temperature of the temperature-sensitive magnetic member 64 is at least within the temperature range not greater than the permeability change start temperature.

Thirdly, multiple slits 64*s* each dividing the flow of an eddy current I generated by the magnetic field lines H are formed in the temperature-sensitive magnetic member 64. Even when the material and the thickness of the temperature-sensitive magnetic member 64 are selected so as not to be easily subjected to induction heating, it is difficult to make the eddy current I generated inside the temperature-sensitive magnetic member 64 be zero (0). In this respect, the amount of eddy current I is decreased by dividing the flow of the eddy current generated in the temperature-sensitive magnetic member 64 with the multiple slits 64*s*. Thereby, Joule heat W generated in the temperature-sensitive magnetic member 64 is suppressed to be low.

Figure 11A:
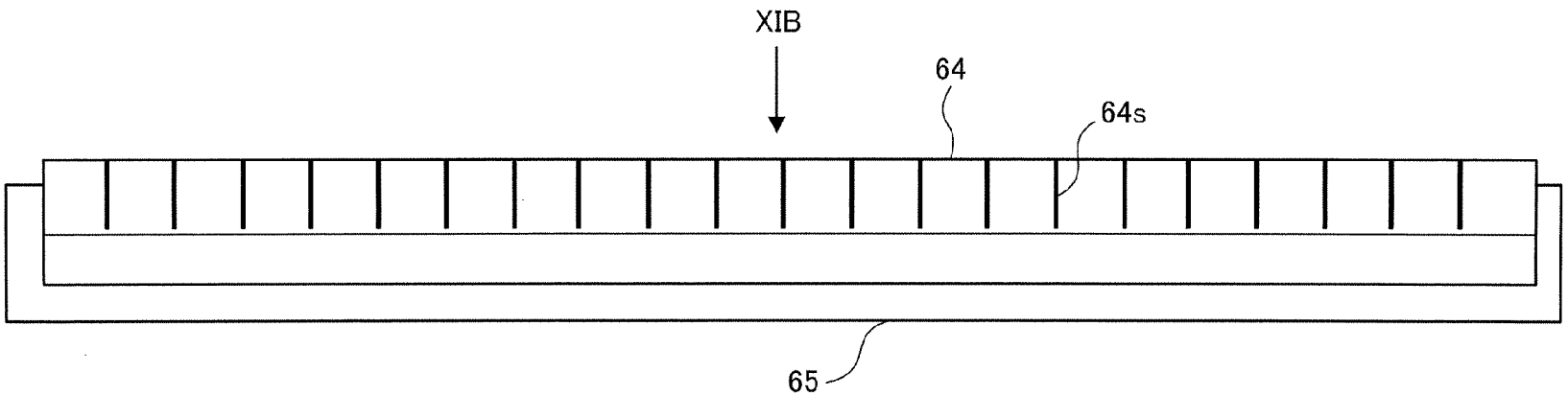
FIGS. 11A and 11B are diagrams showing slits formed in the temperature-sensitive magnetic member.
Figure 11B:
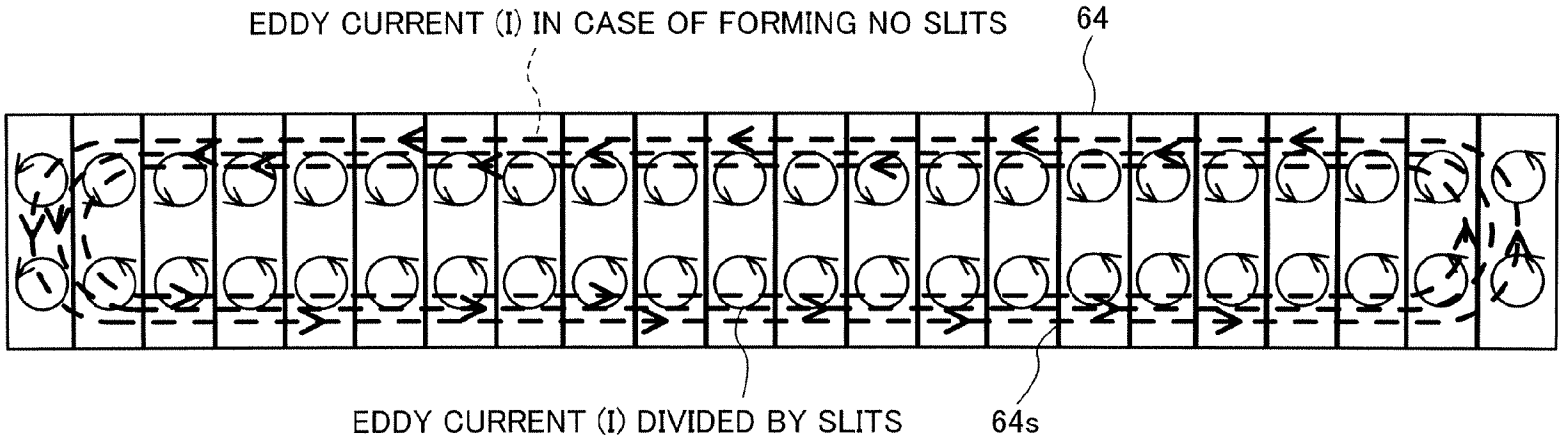

FIGS. 11A and 11B are diagrams showing slits 64*s* formed in the temperature-sensitive magnetic member 64. FIG. 11A is a side view showing a state where the temperature-sensitive magnetic member 64 is mounted on the holder 65. FIG. 11B is a plain view showing a state when FIG. 11A is viewed from above (XIB direction). As shown in FIGS. 11A and 11B, the multiple slits 64*s* are formed in a direction orthogonal to the direction of the flow of the eddy current I generated by the magnetic field lines H, in the temperature-sensitive magnetic member 64. Thereby, the eddy current I (shown by broken lines in FIG. 11B), which flows in the entire temperature-sensitive magnetic member 64 in the longitudinal direction while forming a large swirl in a case of forming no slits 64*s*, is divided by the slits 64*s*. Accordingly, in a case where the slits 64*s* are formed, the eddy current I (shown by a solid line in FIG. 11A) that flows in the temperature-sensitive magnetic member 64 becomes small swirls each being in a region formed between adjacent two of the slits 64*s*, hence reducing the entire amount of the eddy current I. As a result, the amount of heat (Joule heat W) generated in the temperature-sensitive magnetic member 64 decreases. Thereby, the configuration in which heat is not easily generated is achieved. Accordingly, each of the multiple slits 64*s* functions as an eddy current dividing unit that divides the eddy current I.

Note that, the slits 64*s* are formed in the direction orthogonal to the direction of the flow of the eddy current I in the temperature-sensitive magnetic member 64 exemplified in FIGS. 11A and 11B. However, as long as the configuration allows the slits 64*s* to divide the flow of the eddy current I, slits inclined with respect to the direction of the flow of the eddy current I may be formed, for example. Moreover, other than the configuration as shown in FIGS. 11A and 11B in which the slits 64*s* are formed over the entire region in the width direction of the temperature-sensitive magnetic member 64, slits may be partially formed in the width direction of the temperature-sensitive magnetic member 64. Furthermore, the number of, the position of or the inclination angle of slits may be configured in accordance with the amount of heat to be generated in the temperature-sensitive magnetic member 64.

In addition, slits may be formed in the temperature-sensitive magnetic member 64 in a way that the temperature-sensitive magnetic member 64 is divided into a group of small pieces by the slits with an inclination angle of each slit being the maximum. The effects of the present invention may be obtained in this configuration as well.

<Description of Mounting of Temperature-sensitive Magnetic Member onto Holder>

As described in FIGS. 2, 5A and 5B, the fixing belt 61 rotationally moves in a circumferential direction thereof while maintaining the cross sectional shape of each of the both ends of the fixing belt 61 in a substantially circular shape by the end caps 67 provided at the both ends thereof, respectively. Meanwhile, at a region of the fixing belt 61 other than the both ends, the substantially circular cross sectional shape set by the end caps 67 is maintained by the rigidity of the fixing belt 61. However, the fixing belt 61 passes through the peeling nip region 63*b* that locally forms a large nip pressure. At the peeling nip region 63*b*, in order to locally form a large nip pressure, the fixing belt 61 is deformed so as to have a small curvature radius at the surface of the fixing belt 61. Thereby, the fixing belt 61 receives pulling force toward the peeling nip region 63*b*, and as a result, force causing the fixing belt 61 to move to the temperature-sensitive magnetic member 64 side is brought into effect at the downstream side of the fixing belt 61 after the fixing belt 61 passes through the peeling nip region 63*b*.

For this reason, in the longitudinal region of the fixing belt 61 except the both ends, where the substantially circular cross sectional shape thereof is maintained by the rigidity of the fixing belt 61, the orbit of the fixing belt 61 becomes compressed in comparison with a circle so that the compressed part comes closer to the temperature-sensitive magnetic member 64 at the downstream side region of the fixing belt 61 after the fixing belt 61 passes through the peeling nip region 63*b*.

Figure 12:
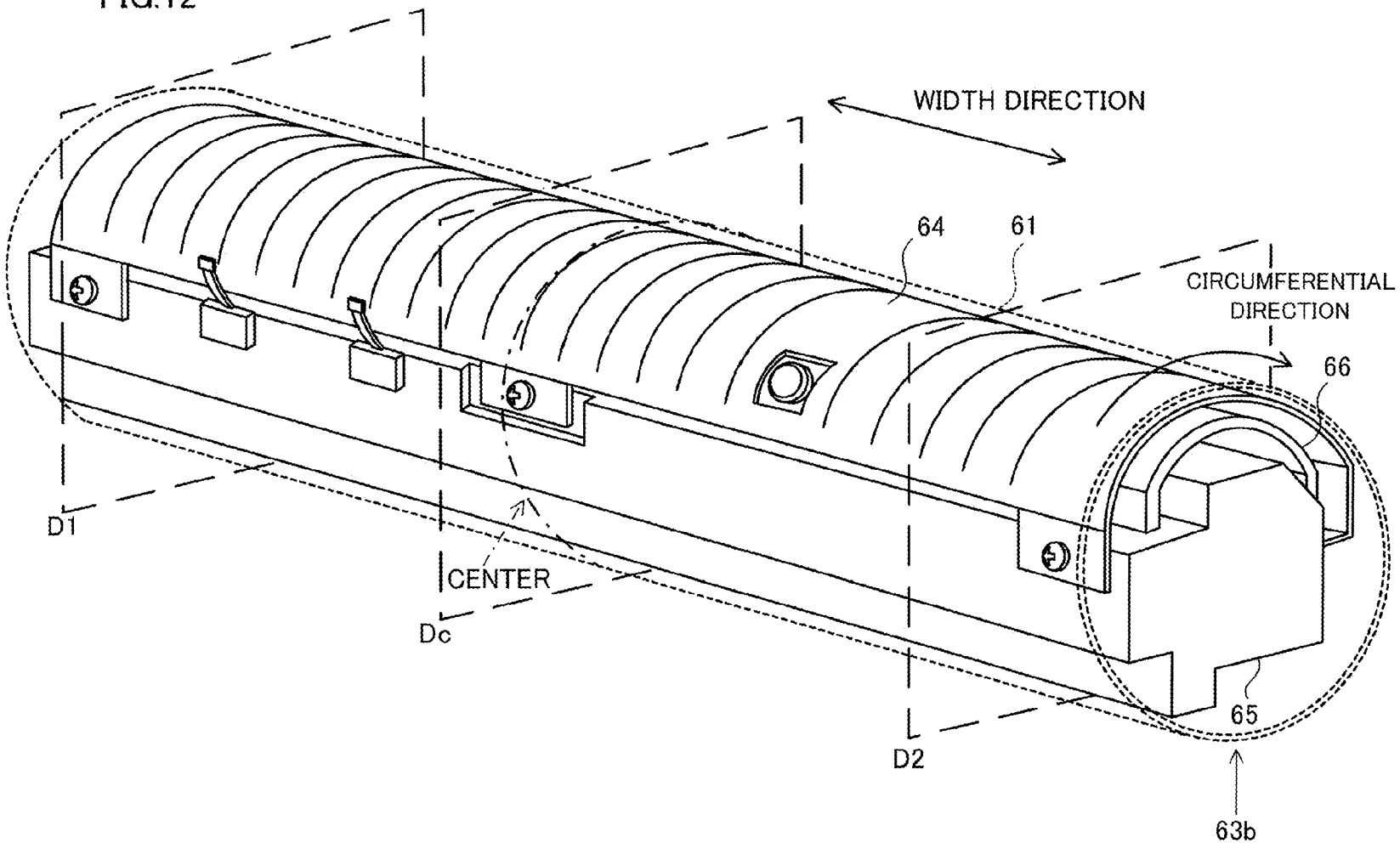
FIG. 12 is a perspective view showing a schematic configuration of the inside of the fixing belt.

FIG. 12 is a perspective view showing a schematic configuration of the inside of the fixing belt 61. In FIG. 12, the fixing belt 61 rotationally moves in a circumferential direction while the cross sectional shape thereof is maintained in a substantially circular shape by the fixing units 67*a* of the end caps 67 at the both end regions closer to the end caps 67 (not shown in FIG. 12, refer to FIGS. 2, 5A and 5B) provided at the both ends, respectively. Specifically, a line of intersection between the fixing belt 61 and each of end side plain surfaces D1 and D2 orthogonal to the width direction of the fixing belt 61 becomes substantially a circular shape.

However, for example, at a center region (center) apart from the end caps 67 provided at the both ends, the fixing belt 61 rotates while maintaining the cross sectional shape thereof set in the circular shape by the end caps 67 with the rigidity of the fixing belt 61. For this reason, the fixing belt 61 receives the pulling force toward the peeling nip region 63*b*, given by the locally large nip pressure at the peeling nip region 63*b*, and thus rotates in the orbit approaching to the temperature-sensitive magnetic member 64. Specifically, the line of intersection between the fixing belt 61 and a center portion plain surface Dc orthogonal to the width direction of the fixing belt 61 becomes an ellipse, which is compressed at the downstream side thereof after the fixing belt 61 passes through the peeling nip region 63*b*.

Figure 13:
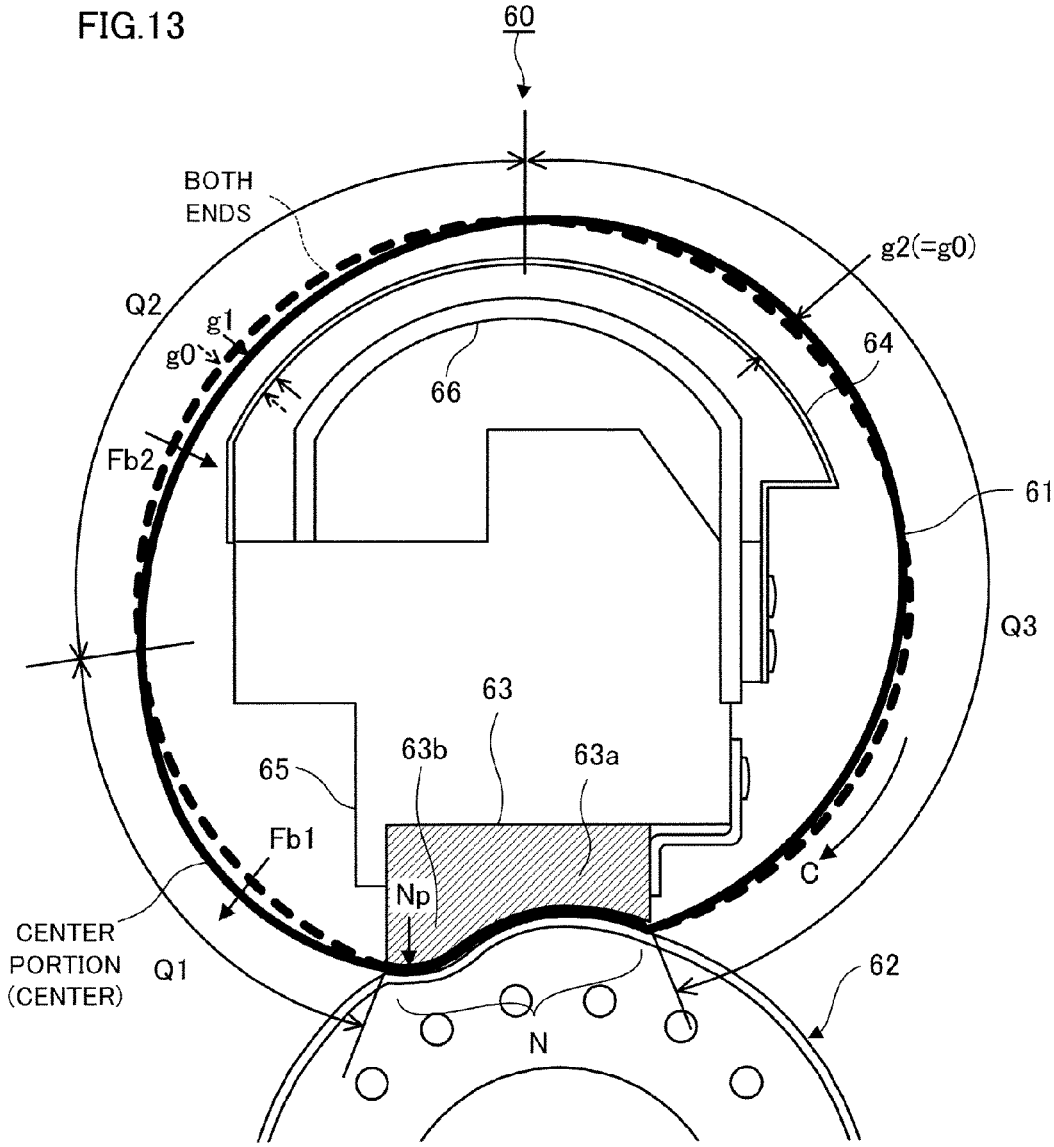
FIG. 13 is a diagram for explaining the orbit of the fixing belt at the region of the center portion apart from the end caps provided at the both ends.

FIG. 13 is a diagram for explaining the orbit of the fixing belt 61 at the region of the center portion (center) apart from the end caps 67 provided at the both ends. In FIG. 13, the orbit of the fixing belt 61 at the region of the center portion (center) is shown by a solid line, and the orbit of the fixing belt 61 at the both end regions is shown by a broken line.

The fixing belt 61 receives a locally large nip pressure Np at the peeling nip region 63*b*. The fixing belt 61 in this case employs the configuration in which the base layer 611 thereof is formed of a material having a high mechanical strength such as a non-magnetic stainless steel in order that buckling or the like occurring due to a torsion torque or compression force does not easily occur (refer to FIG. 4). For this reason, at a downstream side region Q1 immediately after the fixing belt 61 passes through the peeling nip region 63*b*, the orbit of the fixing belt 61 expands outward (Fb1 direction) so as to follow the shape of the pressing pad 63 of the peeling nip portion 63*b* due to the high rigidity of the fixing belt 61. As a result, at a downstream side region Q2, as a reaction of the aforementioned force brought into effect by the high rigidity of the fixing belt 61, the fixing belt 61 moves toward the temperature-sensitive magnetic member 64 (Fb2 direction). Specifically, since the fixing belt 61 does not easily stretch, at the region Q2, the orbit of the fixing belt 61 becomes closer to the temperature-sensitive magnetic member 64, in comparison with the circle, by the amount equal to the circumferential length expanded outward at the region Q1. Accordingly, at the region apart from the both ends of the fixing belt 61 in the width direction, the orbit of the fixing belt 61 becomes an eclipse shape having a compressed portion at the downstream side thereof after the fixing belt 61 passes through the peeling nip portion 63*b* (shown by a solid line in FIG. 13).

Meanwhile, the aforementioned effect is also brought into effect at a region closer to the both ends of the fixing belt 61 in the width direction. However, the force to maintain the shape formed by the end caps 67 is also brought into effect at this region. For this reason, the orbit of the fixing belt 61 is caused to be a substantially circular shape at the region closer to the both ends in the width direction by the end caps 67 (shown by a broken line in FIG. 13).

Accordingly, at the region (region Q2) further downstream side of the fixing belt 61 than the pressing pad 63, a gap g between the fixing belt 61 and the temperature-sensitive magnetic member 64 becomes a gap g1 at, for example, the region of the center portion apart from the both ends of the fixing belt 61 in the width direction, and the gap g1 becomes smaller than a gap 0 at the both ends of the fixing belt 61 in the width direction (g1<g0). In other words, the gap g between the fixing belt 61 and the temperature-sensitive magnetic member 64 becomes smaller in the direction from the both ends (gap g0) to the center portion (gap g1).

As described above, when the gap g between the fixing belt 61 and the temperature-sensitive magnetic member 64 differs between positions in the width direction of the fixing belt 61, the density of the magnetic field lines Hat the region R2 (region corresponding to the region Q2 in FIG. 13) where the magnetic field lines H run across the fixing belt 61 as shown in FIG. 8 also differs between positions in the width direction of the fixing belt 61. For this reason, the amount of heat generated in the fixing belt 61 changes in the direction from the both ends in the longitudinal direction to the center portion, hence causing the fixing properties to differ between positions in the width direction.

Note that, at the region further upstream side than the pressing pad 63, that is, at a region Q3 opposite to the regions Q1 and Q2, the orbit of the fixing belt 61 has the same tendency as the one described above. However, since this region is distant from the peeling nip region 63*b*, the amount of influence of the expansion of the fixing belt 61 at the region Q1 is not so large that the displacement of the orbit is small. For this reason, at the region Q3, the difference between positions in the width direction of the fixing belt 61 at the gap g2 between the fixing belt 61 and the temperature-sensitive magnetic member 64 is small (g2=g0). Accordingly, the difference in the density of the magnetic field lines H at the region R1 (a region corresponding to the region Q3 in FIG. 13) where the magnetic field lines H run across the fixing belt 61 as shown in FIG. 8 is small regardless of positions in the width direction of the fixing belt 61.

As described above, at the region Q2 further downstream side than the pressing pad 63 of the fixing belt 61, the gap g between the fixing belt 61 and the temperature-sensitive magnetic member 64 becomes smaller in the direction from the both ends (gap g0) of the fixing belt 61 toward the center portion thereof (gap g1). For this reason, in the fixing unit of the present exemplary embodiment, the temperature-sensitive magnetic member 64 is caused to be displaced in accordance with the change of the gap g in the width direction so that the gap g between the fixing belt 61 and the temperature-sensitive magnetic member 64 becomes constant over the width direction of the fixing belt 61, at the region Q2 further downstream side than the pressing pad 63 of the fixing belt 61, and is mounted onto the holder 65.

Figure 14:
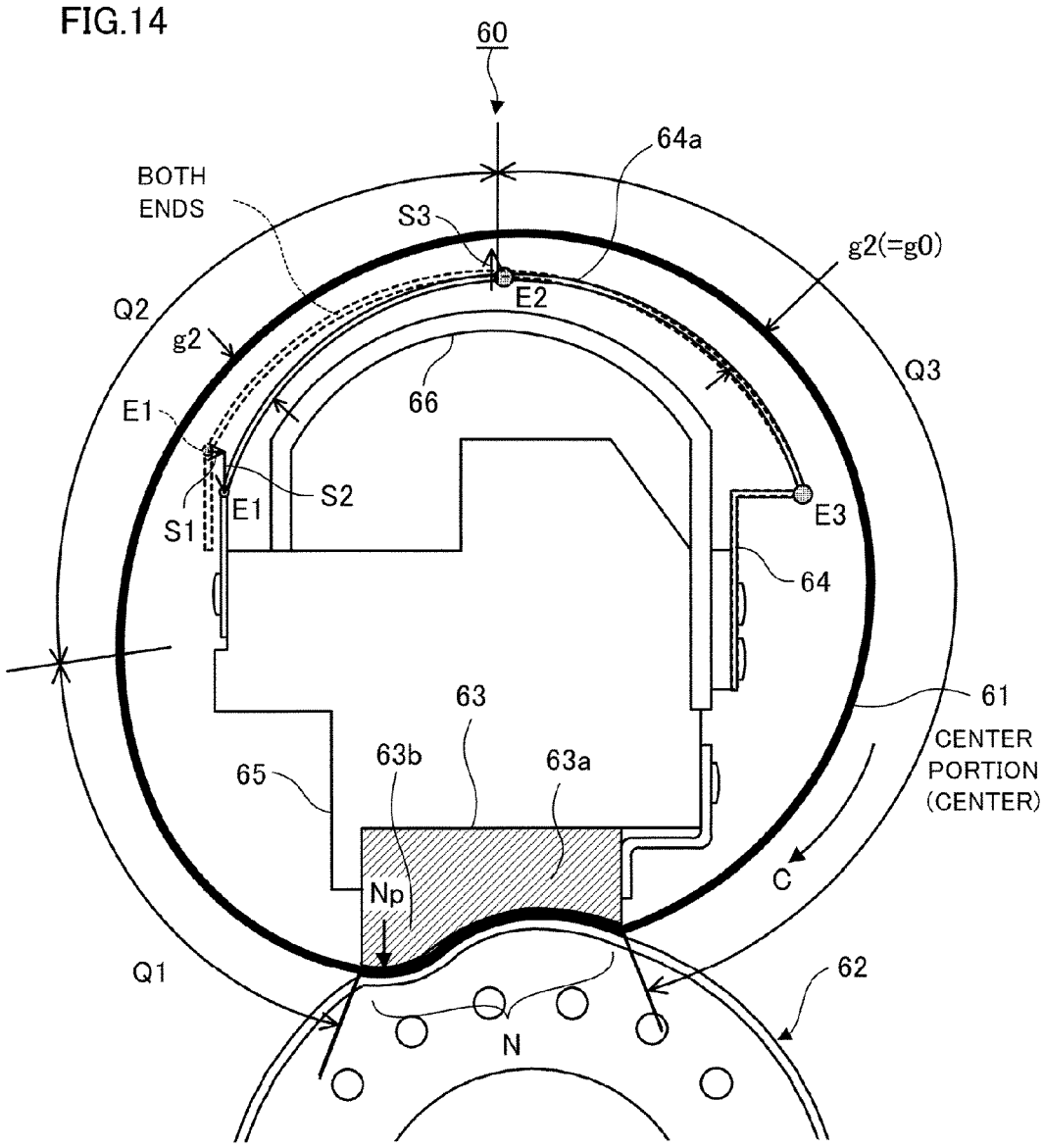
FIG. 14 is a diagram for explaining an attachment position of the temperature-sensitive magnetic member onto the holder at a center position in the width direction.

FIG. 14 is a diagram for explaining an attachment position of the temperature-sensitive magnetic member 64 onto the holder 65 at a center position in the width direction. As shown in FIG. 14, the temperature-sensitive magnetic member 64 is attached to the holder 65 at a region further downstream side than the pressing pad 63 of the fixing belt 61 (region Q2) and a region further upstream side than the pressing pad 63 of the fixing belt 61 (region Q3). The attachment position of the temperature-sensitive magnetic member 64 to the holder 65 at the downstream side region (region Q2) is set at a position where an upstream edge E1 (upstream edge portion) of the curved portion (circular arc shaped portion) 64*a* of the temperature-sensitive magnetic member 64 at the center portion in the width direction of the fixing belt 61 (longitudinal direction of the temperature-sensitive magnetic member 64) is located in an inward direction (S1 direction: direction toward downstream edge E3) in comparison with the edge E1 at the both ends in the width direction, and also where the upstream edge E1 is displaced in a lower direction (S2 direction: direction in which the temperature-sensitive magnetic member 64 separates from the IH heater 80). Thereby, the gap g between the fixing belt 61 and the temperature-sensitive magnetic member 64, which becomes smaller than the gap at the both ends in the width direction of the fixing belt 61 (gap g0=g2) at the region Q2 further downstream side than the pressing pad 63 of the fixing belt 61, becomes wider to be the gap g2 (=g0) at the region of the center portion, for example. Accordingly, the gap g between the fixing belt 61 and the temperature-sensitive magnetic member 64 becomes substantially constant over the width direction of the fixing belt 61.

Note that, the temperature-sensitive magnetic member 64 and an upstream edge E1' of the curved portion 64*a*, which are shown by broken lines in FIG. 14, are ones at the both end positions in the width direction.

Here, the reason for setting the upstream edge E1 of the curved portion 64*a* at the position displaced in the lower direction (S2 direction) is to broaden the gap g between the fixing belt 61 and the temperature-sensitive magnetic member 64, which becomes narrower at the downstream side region Q2. However, at the same time, the temperature-sensitive magnetic member 64 at the upstream side region Q3 is also displaced in the lower direction (S2 direction) when the upstream edge E1 is displaced in the lower direction (S2 direction). Thus, the gap g between the fixing belt 61 and the temperature-sensitive magnetic member 64 is broadened at the upstream side region Q3. For this reason, the upstream edge E1 of the curved portion 64*a* is set at a position displaced in the inward direction (S1 direction), and the curved portion 64*a* of the temperature-sensitive magnetic member 64 is adjusted so as to expand in an upper direction (S3 direction). Thereby, the position of the temperature-sensitive magnetic member 64 at the upstream side region Q3 (position E2, for example), which is displaced in the lower direction (S2 direction) due to the displacement of the upstream edge E1 in the lower direction (S2 direction), is corrected to be in an upper direction (S3 direction). As a result, the amount of change in the gap g between the fixing belt 61 and the temperature-sensitive magnetic member 64 at the upstream side region Q3 becomes extremely small, and the gap g2 (=g0) is maintained.

Figures 15A, 15B:
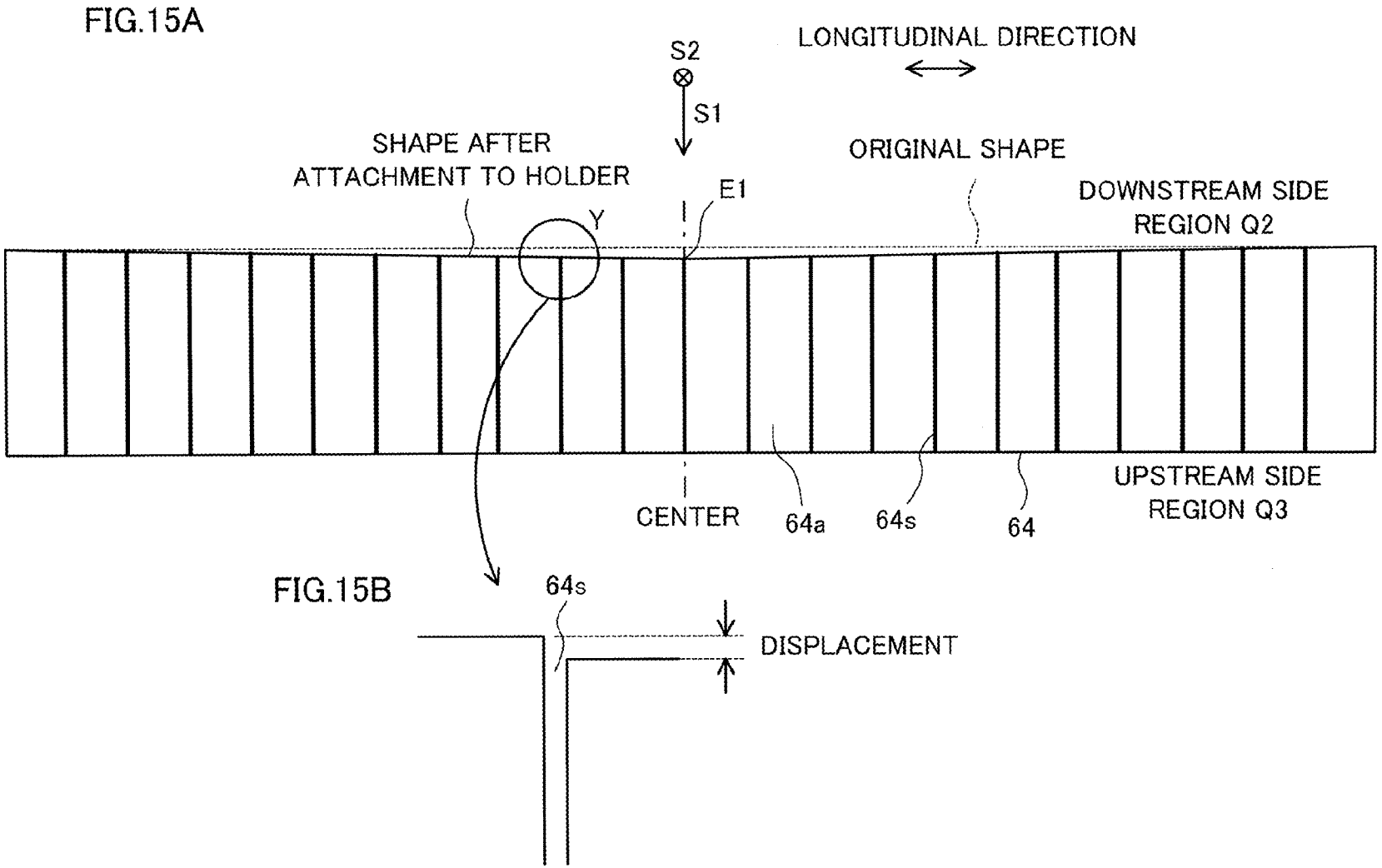
FIG. 15A is a plain view showing, from above, a state where the temperature-sensitive magnetic member is attached onto the holder.
FIG. 15B is an enlarged view of a region Y.

FIG. 15A is a plain view showing, from above, a state where the temperature-sensitive magnetic member 64 is attached onto the holder 65. FIG. 15B is an enlarged view of a region Y shown in FIG. 15A.

The temperature-sensitive magnetic member 64 is set at the holder 65 in a way that the upstream edge E1 of the curved portion 64*a* of the temperature-sensitive magnetic member 64 at the center position thereof in the longitudinal direction is displaced inward (in the S1 direction) in comparison with the upstream edge E1 at the both ends in the longitudinal direction and is displaced downward (in the S2 direction). Accordingly, as shown in FIG. 15A, the temperature-sensitive magnetic member 64 is configured in a shape having a curve protruding in the inward direction (S1 direction), from each of the both ends in the longitudinal direction toward the center position (center), at the downstream side region Q2. Thereby, the gap g between the fixing belt 61 and the temperature-sensitive magnetic member 64 becomes substantially constant over the width direction of the fixing belt 61 because of adjusting the change in the gap g between the fixing belt 61 and the temperature-sensitive magnetic member 64 in the longitudinal direction (width direction of the fixing belt 61) at the downstream side region Q2.

Meanwhile, the shape of the temperature-sensitive magnetic member 64 does not change at the upstream side region Q3. Accordingly, the gap g becomes substantially constant over the width direction of the fixing belt 61 even at the upstream side region Q3 where the amount of change in the gap g between the fixing belt 61 and the temperature-sensitive magnetic member 64 in the longitudinal direction is small.

In this case, when the temperature-sensitive magnetic member 64 is set at the holder 65 in a way that the upstream edge E1 of the curved portion (circular arc shaped portion) 64*a* of the temperature-sensitive magnetic member 64 is displaced inward (in the S1 direction) and downward (in the S2 direction), the deformation (displacement) of the temperature-sensitive magnetic member 64 in the longitudinal direction mainly occurs at an arrangement position of each of the slits 64*s* as an example of notches provided in the curved portion 64*a* of the temperature-sensitive magnetic member 64. Specifically, as shown in FIG. 15B, deformation of the temperature-sensitive magnetic member 64 in the longitudinal direction mainly occurs due to displacement occurring at the both sides of the slit 64*s*. For this reason, a stress is not easily accumulated inside the temperature-sensitive magnetic member 64, and the amount of influence on the magnetic field lines H passing through the inside of the temperature-sensitive magnetic member 64 is suppressed to be small.

As described above, in the fixing unit 60 of the present exemplary embodiment, when the temperature-sensitive magnetic member 64 is attached onto the holder 65, the position (upstream edge position) of the upstream edge E1 of the curved portion (circular arc shaped portion) 64*a* of the temperature-sensitive magnetic member 64 is displaced in accordance with the change of the gap g between the fixing belt 61 and the temperature-sensitive magnetic member 64 in the width direction. Thereby, even at the region Q2, which is the region further downstream side than the pressing pad 63 of the fixing belt 61, the gap g between the fixing belt 61 and the temperature-sensitive magnetic member 64 becomes substantially constant over the width direction of the fixing belt 61. The density of the magnetic field lines H at the region R2 (region corresponding to the region Q2 in FIG. 13) where the magnetic field lines H run across the fixing belt 61 is made to be uniform in the width direction of the fixing belt 61.

Note that, the present exemplary embodiment shows a case in which the temperature-sensitive magnetic member 64 is formed as a single unit over the entire width of the fixing belt 61. However, instead of this configuration, a configuration in which the temperature-sensitive magnetic member 64 is divided into pieces in the width direction of the fixing belt 61 may be employed.

Figure 16:
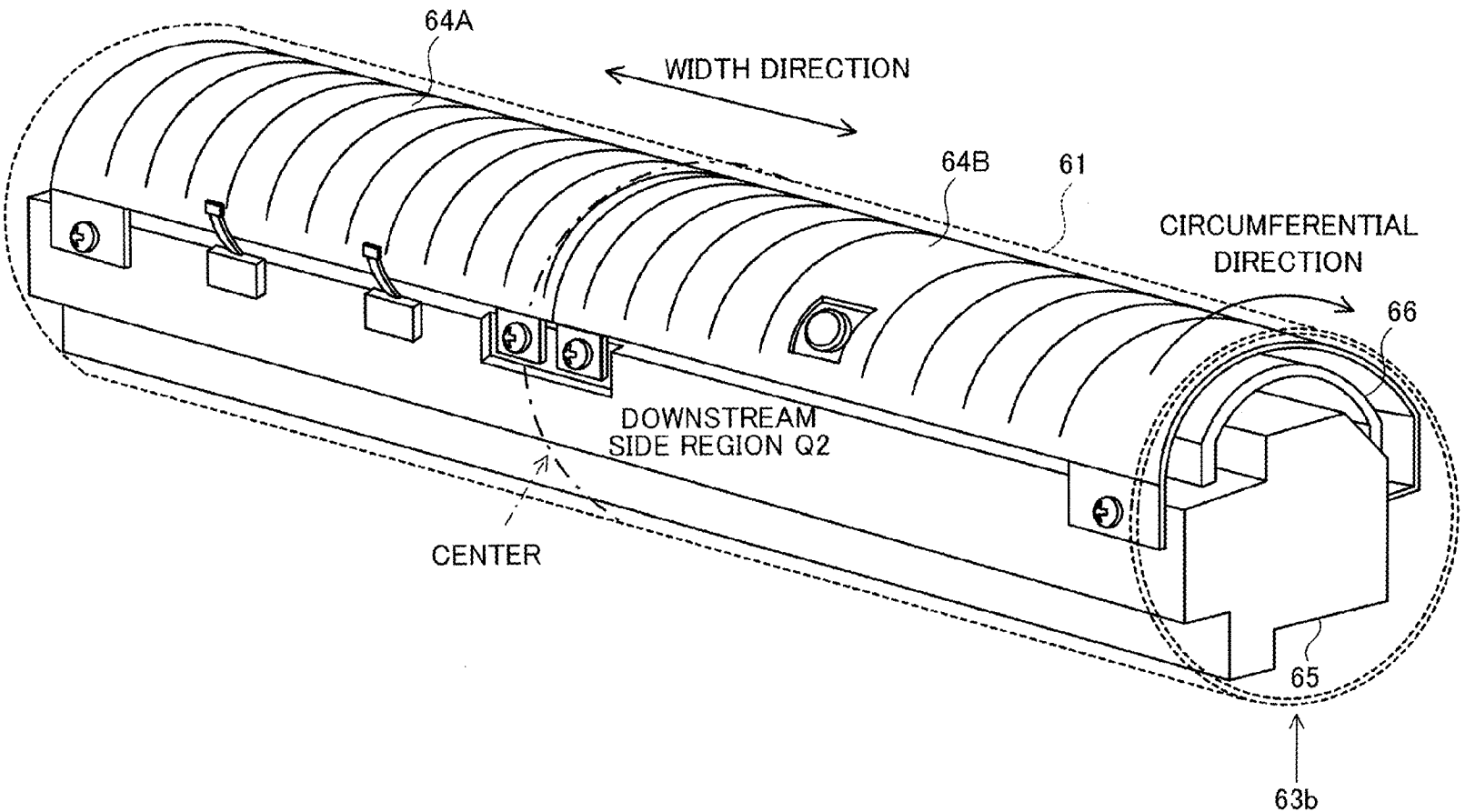
FIG. 16 is a perspective view showing a configuration example in which the temperature-sensitive magnetic member is divided into two pieces in the width direction of the fixing belt.

FIG. 16 is a perspective view showing a configuration example in which the temperature-sensitive magnetic member 64 is divided into two pieces in the width direction of the fixing belt 61. In the configuration example shown in FIG. 16, two temperature-sensitive magnetic members 64A and 64B are respectively arranged at regions from the respective ends in the width direction of the fixing belt 61 toward the center portion (center). At the downstream side region Q2, each of the temperature-sensitive magnetic members 64A and 64B is attached to the holder 65 at a corresponding one of the ends in the width direction of the fixing belt 61 and the center portion (center). When attached to the holder 65 at the center portion (center), as in the aforementioned case, each of the temperature-sensitive magnetic members 64A and 64B is set at a position where the upstream edge E1 of the curved portion 64*a* of a set of temperature-sensitive magnetic members 64 is displaced inward (in the S1 direction) and downward (in the S2 direction) in comparison with that of the both ends in the width direction (refer to FIG. 14).

When the temperature-sensitive magnetic member 64 is configured to be divided into pieces in the width direction of the fixing belt 61 as described above, the length of each of the divided temperature-sensitive magnetic members 64 in the longitudinal direction is made smaller, thereby allowing the temperature-sensitive magnetic member 64 to be easily deformed in the longitudinal direction.

As described above, in the fixing unit 60 included in the image forming apparatus 1 of the present exemplary embodiment, the temperature-sensitive magnetic member 64 is arranged so as to be close to the inner circumferential surface of the fixing belt 61. Thereby, an excessive increase in the temperature of the non-sheet passing regions is suppressed.

Moreover, the position (upstream edge position) of the upstream edge E1 of the curved portion (circular arc shaped portion) 64*a* of the temperature-sensitive magnetic member 64 is displaced in accordance with the change in the gap g between the fixing belt 61 and the temperature-sensitive magnetic member 64 in the width direction when the temperature-sensitive magnetic member 64 is attached to the holder 65. Thereby, even at the region Q2, which is a position further downstream side than the pressing pad 63 of the fixing belt 61, the gap g between the fixing belt 61 and the temperature-sensitive magnetic member 64 becomes substantially constant over the width direction of the fixing belt 61. Accordingly, the density of the magnetic field lines H at the region where the magnetic field lines H run across the fixing belt 61 is made to be uniform in the width direction of the fixing belt 61. As a result, the amount of heat generated in the fixing belt 61 becomes substantially constant in the width direction thereof. Thus, the occurrence of non-uniform fixation is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that includes a conductive layer and that fixes toner on a recording medium by self-heating the conductive layer by electromagnetic induction;

a magnetic field generating member that generates an alternate-current magnetic field intersecting with the conductive layer of the fixing member;

a magnetic path forming member that includes a circular arc shaped portion arranged so as to face the magnetic field generating member with the fixing member interposed between the circular arc shaped portion and the magnetic field generating member, that forms a magnetic path of the alternate-current magnetic field generated by the magnetic field generating member, within a temperature range up to a permeability change start temperature at which a permeability starts to decrease in the circular arc shaped portion, and that allows the alternate-current magnetic field generated by the magnetic field generating member to go through the magnetic path forming member within a temperature range exceeding the permeability change start temperature; and a support member that supports the magnetic path forming member, wherein the magnetic path forming member is mounted on the support member so that a position of an upstream edge of the circular arc shaped portion in a moving direction of the fixing member is displaced in a direction away from the fixing member while the displacement of the position is larger toward a center of the magnetic path forming member from each of ends of the magnetic path forming member in a longitudinal direction.

2. The fixing device according to claim 1, wherein the magnetic path forming member is mounted on the support member so that the upstream edge of the circular arc shaped portion at the center in the longitudinal direction is arranged, in a direction closer to a downstream edge of the circular arc shaped portion in the moving direction of the fixing member, and in a direction away from the magnetic field generating member, in comparison with the upstream edge at the ends in the longitudinal direction, and wherein the magnetic path forming member includes a plurality of notches that are each orthogonal to the longitudinal direction and that are arranged in the longitudinal direction.

3. The fixing device according to claim 1, wherein the magnetic path forming member is divided into a plurality of pieces and then arranged in a width direction of the fixing member.

4. The fixing device according to claim 1, wherein the magnetic path forming member is arranged without being in contact with the fixing member.

5. An image forming apparatus comprising:

a toner image forming unit that forms a toner image;

a transfer unit that transfers the toner image formed by the toner image forming unit onto a recording medium; and a fixing unit that fixes, to the recording medium, the toner image transferred onto the recording medium;

the fixing unit containing:

a fixing member that includes a conductive layer and that fixes toner on the recording medium by self-heating the conductive layer by electromagnetic induction;

a magnetic field generating member that generates an alternate-current magnetic field intersecting with the conductive layer of the fixing member;

a magnetic path forming member that includes a circular arc shaped portion arranged so as to face the magnetic field generating member with the fixing member interposed between the circular arc shaped portion and the magnetic field generating member, that forms a magnetic path of the alternate-current magnetic field generated by the magnetic field generating member, within a temperature range up to a permeability change start temperature at which a permeability starts to decrease in the circular arc shaped portion, and that allows the alternate-current magnetic field generated by the magnetic field generating member to go through the magnetic path forming member within a temperature range exceeding the permeability change start temperature; and a support member that supports the magnetic path forming member, wherein the magnetic path forming member is mounted on the support member so that a position of an upstream edge of the circular arc shaped portion in a moving direction of the fixing member is displaced in a direction away from the fixing member while the displacement of the position is larger toward a center of the magnetic path forming member from each of ends of the magnetic path forming member in a longitudinal direction.

6. The image forming apparatus according to claim 5, wherein the magnetic path forming member of the fixing unit is mounted on the support member so that the upstream edge of the circular arc shaped portion at the center in the longitudinal direction is arranged, in a direction closer to a downstream edge of the circular arc shaped portion in the moving direction of the fixing member, and in a direction away from the magnetic field generating member, in comparison with the upstream edge at the ends in the longitudinal direction, and wherein the magnetic path forming member of the fixing unit includes a plurality of notches that are each orthogonal to the longitudinal direction and that are arranged in the longitudinal direction.

7. The image forming apparatus according to claim 5, wherein the magnetic path forming member of the fixing unit is divided into a plurality of pieces and then arranged in a width direction of the fixing member.

8. The image forming apparatus according to claim 5, wherein the magnetic path forming member of the fixing unit is arranged without being in contact with the fixing member.

* * * * *